US006702288B1

(12) United States Patent
Ohman

(10) Patent No.: US 6,702,288 B1
(45) Date of Patent: Mar. 9, 2004

(54) COLOR GAME

(76) Inventor: Frances M. Ohman, P.O. Box 117, East Smethport, PA (US) 16730

( * ) Notice: Subject to any disclaimer, the term of this patent is extended or adjusted under 35 U.S.C. 154(b) by 0 days.

(21) Appl. No.: 10/293,484

(22) Filed: Nov. 14, 2002

(51) Int. Cl.[7] ..... A63F 3/00
(52) U.S. Cl. ..... 273/271; 273/269
(58) Field of Search ..... 273/269, 270, 273/271

(56) References Cited

U.S. PATENT DOCUMENTS

| | | | | |
|---|---|---|---|---|
| 3,549,150 | A | | 12/1970 | Weeks |
| 3,690,671 | A | | 9/1972 | Slutsky |
| 3,707,287 | A | | 12/1972 | Spector |
| 3,977,681 | A | | 8/1976 | Deitrich |
| 4,169,601 | A | | 10/1979 | Frischmann et al. |
| 4,221,388 | A | | 9/1980 | Carini |
| 4,373,732 | A | * | 2/1983 | Ogilvie |
| 4,463,952 | A | | 8/1984 | Rowbal |
| 4,804,190 | A | | 2/1989 | Hofmann |
| 4,981,301 | A | | 1/1991 | Frain |
| 5,054,789 | A | | 10/1991 | Pellerin |
| 5,139,270 | A | | 8/1992 | Gernhofer |
| D356,834 | S | | 3/1995 | Steffensen |
| 5,449,179 | A | | 9/1995 | Hefferan |
| D363,318 | S | | 10/1995 | Stephan |
| 5,458,338 | A | | 10/1995 | Beardsley |
| 5,491,324 | A | | 2/1996 | Vanderpool |
| 5,601,288 | A | | 2/1997 | White et al. |
| 5,624,119 | A | | 4/1997 | Leake |
| 5,653,443 | A | | 8/1997 | Ervin |
| 5,743,740 | A | | 4/1998 | Visser et al. |
| 5,823,534 | A | | 10/1998 | Banyai |
| D407,125 | S | | 3/1999 | Hopkins |
| 5,909,875 | A | | 6/1999 | Weingardt |
| 5,935,002 | A | | 8/1999 | Falciglia |
| 6,079,710 | A | | 6/2000 | Brown |
| 6,234,483 | B1 | | 5/2001 | Bucan |
| D453,801 | S | | 2/2002 | Wimberly |

FOREIGN PATENT DOCUMENTS

| | | |
|---|---|---|
| JP | 10-116018 | 5/1998 |

OTHER PUBLICATIONS

Teddy Bear Color Bingo, http://www.teachchildren.com/wmb7224.html, Feb. 7, 2003.*

Epinions.com, Color Bingo game, by bmcnichol, http://www.epinions.com/kifm–review–4B43–2FB7AD56–3A5351F7–prod2, Jan. 3, 2001.*

Ebay.com, Active Learning–Color & Shape Bigo–3–36 play, Feb. 7, 2003.*

* cited by examiner

*Primary Examiner*—William M. Pierce
(74) *Attorney, Agent, or Firm*—Richard C. Litman

(57) ABSTRACT

A color game provides an enjoyable and entertaining activity for young children, persons learning a language, and others, in assisting those persons to associate color names with corresponding colors. The game includes a series of individual player cards or boards, with each card having a series of rows of colored positions thereon. Each row may contain identical colors for each position thereof, with the number of positions in each row being different, e.g., rows arranged in a triangular matrix, etc. Other board configurations may be provided as desired. Each player has a series of markers for placement upon the colored positions of his or her card. A caller randomly selects colored markers and announces the selected color, with players attempting to match the called color on their cards by placing markers on the appropriate card positions. The object is to completely cover all card positions.

6 Claims, 16 Drawing Sheets

COLOR GAME

BACKGROUND OF THE INVENTION

1. Field of the Invention

The present invention relates generally to board games and the like, and more specifically to a matching game incorporating a series of differently patterned game boards, with each player having a distinctive board. Players attempt to match colors called by a caller to the color patterns displayed on their boards. While the present color game is directed to a board game, it may be readily adapted to computer play, if so desired.

2. Description of the Related Art

A number of different board games have been developed in the past, which require players to match called symbols (letters, numbers, etc.) with a unique pattern on their individual game board. In such games, a single caller draws symbols randomly from a source (container, etc.), and calls out the specific symbol drawn on each turn. Players attempt to locate a matching symbol on their game boards, and place markers on the appropriate locations on their game boards when matches occur.

Perhaps the best known of such matching board games is Bingo®, in which a series of letters and numbers are used to define board positions, with each board having a unique letter-number combination. While every board and all markers use the five alphabetic letters contained in the name "Bingo," the numbers associated with the letters may vary widely to provide a large number of different and unique playing boards. Moreover, where the same letter-number combinations are used between different boards, their positions vary between boards, in order to make each game board distinct from every other board. A caller sequentially randomly draws letter-number markers, with players attempting to find matches on their individual boards. The first player to complete a horizontal, vertical, or diagonal row across their individual board, wins the game.

While such a game may be a reasonably enjoyable pastime for literate persons who readily recognize the letter and number combinations of the game, it is not suitable for illiterate or dyslexic players who do not recognize the various alphanumeric combinations used in the game, nor to young children who are incapable of matching such combinations received audibly with the combinations shown in their game boards. Moreover, the Bingo® game board is limited to a square matrix of only twenty five playing positions, due to the five letters of the word arranged horizontally to define five vertical columns and corresponding five horizontal rows across the columns.

The present inventor is also aware of a number of other loosely related games which operate using similar principles or rules, as discussed further below. However, where those games utilize colors in their play, they also either require some letter and/or number combination and recognition by the players, or differ widely in the method of play from the matching of attributes (colors, letters, numbers, shapes, etc.) called by a single caller for the game.

Accordingly, a need will be seen for a color matching game, which requires no previous reading or numerical skills by the players. The present color game requires only that players be able to recognize basic colors, and to match the visual representation of such colors when they hear the specific colors announced audibly. The present game is thus suitable for preschool children, as well as others who may be illiterate or dyslexic. Yet, the present game provides sufficient complexity to be interesting to older children as well, with its relatively large number of different colors on each board, the varying numbers of positions for each color on each game board, and various other features, as well. The present game is also adaptable to a wide variety of different board configurations and color pattern layouts, as well.

A discussion of the related art of which the present inventor is aware, and its differences and distinctions from the present invention, is provided below.

U.S. Pat. No. 3,549,150 issued on Dec. 22, 1970 to James F. Weeks, titled "Color-Number Association Game Apparatus," describes a Bingo-like game in which each player receives a distinct game board. Each board includes the word "COLORS" across the top, with a differently colored column extending downwardly below each letter of the word. The Weeks game differs from the present game, in that Weeks states that he prefers to have all of the differently colored columns arranged in the same order across all of the boards, with the only difference between boards being the arrangement of the numbers within each of the colored columns. Weeks also uses colored and numbered dice to determine the color land number combinations to be played. The present game is based only on colors, with at least some embodiments varying the number of positions having any given color, between different rows or areas of the board and between different boards.

U.S. Pat. No. 3,690,671 issued on Sep. 12, 1972 to Linda F. Slutsky, titled "Educational Color Association Game," describes a game in which a large number of differently colored, interlocking tiles are selectively joined to form panels of differently colored tiles. The person assembling the tiles places at least one common color on each panel, and may include a single unique color on only one of the panels. The object is to teach fine color and tint recognition to persons playing the game, by having them match the matching colors in different panels. However, no random callout of colors by a caller, nor actual physical placement of markers by players, is provided by Slutsky.

U.S. Pat. No. 3,707,287 issued on Dec. 26, 1972 to Berdine E. Spector, titled "Color Familiarization Game," describes a puzzle-like device having a background with a series of differently colored panels thereon. A series of puzzle pieces matching the colors is provided, with another series of pieces having the names of the colors thereon also provided. The object is to assemble each specifically colored piece with the corresponding piece having the name of that color thereon, and place it on the correspondingly colored position in the background panel. If the puzzle is assembled properly, a picture is correctly displayed on the back of the assembly. The Spector puzzle does not provide any competitive aspect of play, as does the present game, nor are unique game boards provided to each player by Spector.

U.S. Pat. No. 3,977,681 issued on Aug. 31, 1976 to Jerry D. Deitrich, titled "Game Using A Board And Playing Pieces," describes a game somewhat resembling the game of dominoes, in which the object is to arrange one's playing tiles so the numbers of pips on one portion of a given tile, match numerically with an adjacent tile. The Deitrich game includes playing pieces or tiles of only two different colors, with players attempting to match like colors upon adjacent tiles. Points are awarded for such matches during play. The present game differs considerably, in that no numerical scoring is provided and many more colors are used, with players being required to place markers upon colored positions on their individual playing boards as called by the caller, rather than matching a tile to the color of an existing previously played tile.

U.S. Pat. No. 4,169,601 issued on Oct. 2, 1979 to Richard D. Frischmann et al., titled "Sound Bingo," describes a Bingo-like game in which a series of individual game boards each include a number of different sound producing objects thereon. The caller or controller of the game plays a specific sound of short duration on a sound producing device, with players attempting to match the sound with one of the objects pictured on their boards and placing a marker upon any object matched. Frischmann et al. do not provide any color differentiation in their game, nor do they provide differing numbers of positions having a specific attribute (e.g., sound), as do the present game boards with their differing numbers of colors in rows of differing lengths, in at least some embodiments.

U.S. Pat. No. 4,221,388 issued on Sep. 9, 1980 to Edward Carini, titled "Color Matching Game," describes a game having an elongated board with a pair of identical elongate strips having a series of different colors therealong. The two strips are placed on the board, facing in opposite directions. The strips may be positioned adjacent to one another with only one of their common colors being immediately adjacent. Colors corresponding to those on the strip are randomly selected, with each player in turn repositioning his or her color strip to align the selected colors of the two strips. The first player to move his or her strip to the end of the board, wins the game. Only two players can play the Carini game, and there is no provision for matching colors on a series of distinct playing boards by placing markers thereon.

U.S. Pat. No. 4,463,952 issued on Aug. 7, 1984 to Robert M. Rowbal, titled "Color Match Board Game," describes a game similar to dominoes, but differing in that the playing tiles are colored with different colors along each side or edge thereof. The object is to position the tiles so that like colors are adjacent one another, and adjacent the colors provided along the edges of the playing board to start the game. Tiles are drawn randomly by each player in turn. No colors are provided on the playing field of the board itself, other than along the edges of the board as starting positions for the game. Thus, Rowbal does not make any provision for positioning tiles atop a colored position on the board, as is the case with the present color game. Moreover, each player selects tiles randomly in turn in the Rowbal game, rather than all players working with the same color simultaneously in each turn of play, as in the present game.

U.S. Pat. No. 4,804,190 issued on Feb. 14, 1989 to Elsa O. Hofmann, titled "Outer Space Travelling Board Game," describes a board game having a progressive playing path thereon. A series of cards are provided, with the cards including various astronomical objects and a series of colored marks. Players draw cards at random, and move markers to correspondingly colored or marked positions along the playing path of the game board. Only one marker is provided per player, and no provision is made for covering a series of differently colored playing positions with a series of markers, nor for simultaneous play attempts by all players at each turn, as in the present game.

U.S. Pat. No. 4,981,301 issued on Jan. 1, 1991 to John J. Frain, titled "Bingo Game For Multiple Plays," describes a game having a Bingo-type overlay board with a series of holes formed therethrough, at each of the playing positions. A marking sheet is Iprovided for placement below the board, with the sheet including a series of indexing holes and a corresponding series of colored positions thereon. The colored positions of any given color correspond to one of the indexing hole positions, so that when the marking sheet is positioned beneath the board, the corresponding color will be visible through each of the holes in the board. The player marks the sheet according to the letter and number combinations called by the caller. The sheet may be reused, according to the number of indexing holes and corresponding colors provided in the marking sheet. The only use of the colors in the Frain system is to indicate the proper position of the sheet for any given game; no matching of colors during play is provided.

U.S. Pat. No. 5,054,789 issued on Oct. 8, 1991 to Curtis L. Pellerin, titled "Method And Apparatus For The Play Of A Matching Game," describes a game having one position for each of the letters of the alphabet and ten additional positions for the numbers one through ten. A series of corresponding blocks is provided for the board positions, and a series of tiles is provided which are drawn randomly and in turn by the players. The object is to collect the greatest stack of blocks removed from the board, by matching them with the tiles. The game may be color coded, but no placement of markers on the board according to color, is provided.

U.S. Pat. No. 5,139,270 issued on Aug. 18, 1992 to Margaret A. Gernhofer, titled "Name Game Bingo," describes a Bingo-type game in which most of the board positions include illustrations relating to the circus, with a series of open positions provided in which the name of each of the players must be entered. The object is the same as in the original game of Bingo®, i.e., to form a continuous horizontal, vertical, or diagonal line of markers on the board. Gernhofer does not provide any color differentiation of her playing positions, nor is there any provision for the recognition of color in the Gernhofer game.

U.S. Pat. No. 5,449,179 issued on Sep. 12, 1995 to Laurel A. Hefferan, titled "Holiday Bingo Having Stickers And Candy Markers," describes a series of Bingo-type games, each having a different theme and corresponding series of illustrations on the game boards, in keeping with the specific theme of the board. The caller uses a master board or sheet having the corresponding illustrations thereon, and calls illustrations or symbols randomly. Players position markers on the illustrations or symbols of their boards accordingly, in accordance with the general rules and procedure used for playing the game of Bingo®. While Hefferan discloses the use of symbols or illustrations, and also uses some holiday themed colors, she does not provide a game in which the players each receive a playing board or card solely marked with a series of different colors thereon, and requiring the players to completely cover all of the differently colored positions on their boards in order to win, as in the case of the present color game.

U.S. Pat. No. 5,458,338 issued on Oct. 17, 1995 to Richard Beardsley, titled "Game For Teaching Grammar," describes a game similar to Bingo®, but in which the individual player cards have a series of linguistic terms, e.g., parts of speech, punctuation, etc. A caller randomly selects a card corresponding to one of the linguistic terms of the player card(s), and reads one or more examples from the card. A question is then asked of the players, with a player correctly responding, and having the corresponding linguistic term on his or her card or board, placing a marker on that position on the board. As in the game of Bingo®, the object is to form a horizontal, vertical, or diagonal line across the board. Beardsley does not disclose any form of color differentiation in his game, nor does he require players to cover all positions on their boards in order to win, as in the case of the present game. The Beardsley game with its requirement of fairly sophisticated knowledge of English grammar and syntax, is relatively complex in comparison to the present game.

U.S. Pat. No. 5,491,324 issued on Feb. 13, 1996 to Frank Vanderpool, titled "Score-Keeping-With-Carry Score Boards," describes a mechanical scoreboard for keeping track of the score in various card games, particularly the game of cribbage. The device includes a series of holes or slots which correspond to different scores possible, and a corresponding series of pegs or slides positionable in the holes or slots to indicate the score. The Vanderpool device is not closely related to the present color game, and no colors or matching of colors are disclosed by Vanderpool.

U.S. Pat. No. 5,601,288 issued on Feb. 11, 1997 to Daniel D. White et al., titled "Chips Down Board Game," describes a game utilizing both colors and numbers. The game board has a series of identical numbers for each of several players, with the number positions also being color coded. Players draw cards in turn, with the cards having numbers and colors corresponding to those of the board. The object is to place markers on the board positions when a corresponding card is drawn, with players attempting to select positions which will form a row of five markers. The White et al. game differs from the present color game in that White et al. (1) require knowledge of basic numbers, in addition to color recognition; (2) provide only a single board for a plurality of players; (3) provide for opponents to block rows being formed, depending upon the opponents' card draws and play; and (4) permit markers to be removed from the board by opponents, under certain circumstances. Other differences exist as well.

U.S. Pat. No. 5,624,119 issued on Apr. 29, 1997 to Deborah L. Leake, titled "Multiple Variable Game Equipment And System For Generating Game Faces," describes a Bingo-like game in which the various positions on the playing cards have features in addition to the conventional letter and number designators used in Bingo@. Leake provides cards in which the positions may have different colors, shapes, alphabetic characters, etc., to provide additional variables in play. However, Leake uses conventional Bingo® rules of play, and does not provide different board shapes or require that the entire board be covered, as in play of the present game.

U.S. Pat. No. 5,653,443 issued on Aug. 5, 1997 to David B. Ervin, titled "Rotatable Cribbage Board," describes different embodiments of a cribbage score board formed in a circular configuration, with the pegging hole paths laid out around the circumference of the board. The Ervin device does not relate to the color game of the present invention.

U.S. Pat. No. 5,743,740 issued on Apr. 28, 1998 to Richard Visser et al., titled "Educational Word And Letter Game And Method Of Playing," describes a Bingo-like game in which each player has a different card, with each card having a series of letter, word, picture, or other designations placed in a series of squares on the board. A series of cards having designations corresponding to the designations on the playing boards or cards, is also provided. A caller draws cards randomly and reads the designation or describes the picture on each card, with players permitted to cover positions on their playing boards which match corresponding designations read off by the caller. Rules for winning are the same as in Bingo®, i.e., by forming a row of markers across the board. Visser et al. do not provide a purely color game, as in the present color game, but require additional skills over and above color recognition. Moreover, the Visser et al. game does not provide any variation in the game board layout for the players, as provided by the triangular and other board configurations of the present game. Finally, Visser et al. require only that a single row be formed to win, rather than covering the entire board, as in the present game.

U.S. Pat. No. 5,823,534 issued on Oct. 20, 1998 to Frank B. Banyai, titled "Table Bingo Game Method," describes a Lotto® or Keno® type game, in which players select a relatively few numbers (e.g., three). A series of numbers are randomly selected, with the winning player having his or her selected numbers matched by the randomly selected called numbers. Banyai relates his game to Bingo®, but his game appears to be more closely related to numbers or lottery type games. In any event, Banyai does not provide any form of color matching in his game, either in matching all of a single color, or all colors on a board containing a pattern of different colors thereon, as in the present color game invention.

U.S. Pat. No. 5,909,875 issued on Jun. 8, 1999 to Gary Weingardt, titled "Keno Game," describes the modification of a conventional Keno® game by randomly adding a colored background to some of the numbers used in the game. A player having a winning selection of colored numbers, or at least some percentage thereof, is awarded a bonus in addition to the payout for the winning numbers. The Weingardt game does not require the players to match specific colors per se, as is required in the present game. Rather, players must match the randomly selected numbers of the Keno® game, with the colors being essentially a side bet, or more accurately, a side or additional payout, for selecting some or all numbers having a colored background. The present game does not utilize any alphanumeric characters in its play, but requires only that colors be matched with those called. Moreover, the present game requires players to cover the entire board, as well.

U.S. Pat. No. 5,935,002 issued on Aug. 10, 1999 to Sal Falciglia, titled "Computer-Based System And Method For Playing A Bingo-Like Game," describes a computerized, electronic game containing a five by five matrix of numbers. Individual numbers are randomly generated for matching the numbers on the game board, generally in the manner of Bingo® and similar games. However, Falciglia does not disclose any color patterns for play of his game, nor does he require players to cover or match all of the playing positions on the board, as is done in the present game. While Falciglia does disclose some additional icons for use in the play of his game, he also requires the use of numbers, which method of play is beyond the scope of the present color game invention.

U.S. Pat. No. 6,079,710 issued on Jun. 27, 2000 to Beatrice T. Brown, titled "Educational Number Game," describes a Bingo-like game in which the five by five board has a series of five differently colored columns, each having a series of single digit numbers therein. A series of differently colored and numbered cards is provided, with a caller announcing the color and number of each card randomly selected in turn. Players attempt to complete a row of markers placed upon corresponding numbers in correspondingly colored rows of their playing boards. The primary difference between the Brown game and Bingo®, is that Brown uses colors to distinguish the different columns, rather than the letters forming the word "Bingo." Brown does not disclose any purely colored game boards, nor the covering of all the positions on the boards with markers, as in the present color game.

U.S. Pat. No. 6,234,483 issued on May 22, 2001 to Blair Bucan, titled "Method Of Playing A Matching Card Game,"

describes a game utilizing two decks of cards. Players are dealt hands from one deck of cards, with the dealer then drawing cards randomly from the second deck. Players place chips upon the corresponding card when the dealer card matches one of the player cards held by that player. The first player to match each of his or her cards, wins the pot for the game. Bucan does not provide any color matching, nor disclose the use of any colors, in his game. Moreover, while Bucan requires that all of a player's cards be matched in order for that player to win, the player receives only a relatively few cards, and is not required to match a relatively large number of positions, as is the case with the present color game invention.

U.S. Pat. No. D-356,834 issued on Mar. 28, 1995 to Susan E. Steffensen, titled "Picture Bingo Game," illustrates a design having a series of pictures or drawings thereon, in a four by four matrix. No color shading is apparent in the Steffensen design, nor are any rules disclosed for playing the game.

U.S. Pat. No. D-363,318 issued on Oct. 17, 1995 to Ruth A. Stephan, titled "Game Board," illustrates a design having a series of pictures or drawings thereon, in a four by five matrix. No color shading is apparent in the Stephan design. The Stephan game board design more closely resembles the game board of the Steffensen '834 U.S. Design Patent discussed immediately above, than it does the present color game invention.

U.S. Pat. No. D-407,125 issued on Mar. 23, 1999 to Gloria L. Hopkins, titled "Religious Bingo Card," illustrates a design having a series of words found in the Bible, with references to corresponding chapters and verses, in a five by five matrix. No color shading is apparent in the Hopkins design, nor are any rules or method of play disclosed.

U.S. Pat. No. D-453,801 issued on Feb. 19, 2002 to Mildred Wimberly, titled "Bingo Game," illustrates a design having a series of new testament chapters with each having an illustration of a book therewith, in a three by three matrix. The design of the Wimberly '801 U.S. Design Patent, thus more closely resembles the design of the Hopkins '125 U.S. Design Patent, than it does the present color game invention.

Finally, Japanese Patent Publication No. 10-116,018 published on May 6, 1998 to Kanetake Sogo Kenkyusho:KK, titled "Bingo Type Learning Appliance," describes (according to the drawings and English abstract) a game board having a five by five matrix of positions, with a series of flexible magnetic cards each having educational material thereon, for removable attachment thereto. A caller randomly provides a series of cards, with players attempting to match the called cards with the displays on their boards. No color matching is apparent in the '018 Japanese Patent Publication.

None of the above inventions and patents, taken either singly or in combination, is seen to describe the instant invention as claimed. Thus a color game solving the aforementioned problems is desired.

SUMMARY OF THE INVENTION

The present invention comprises a color game, in which one or more players (preferably several) are each provided with a game card or board having a series of differently colored playing positions thereon, and a series of markers for selective placement on the colored positions of the game card. Each of the game cards has different color patterns and/or numbers of positions of a given color from one another, such that only a single player can win. A caller randomly selects differently colored markers corresponding to the game card and player marker colors. Players attempt to match the colored positions on their game cards with the colors called out by the caller, by placing their markers upon the correspondingly colored card or board positions. The object of the game is to completely cover all of the colored positions on the game card, with the first player to do so, winning the game.

The preferred player game card or board for the present color game comprises a triangular matrix of eight rows of color positions, with each row having progressively more positions therein, from one to eight positions. The positions in each row are identically colored, but each row differs in color from every other row. This provides eight factorial combinations, or 40,320 different combinations, when allowing any order of colors for the different rows. The provision of different numbers of positions in each row, requires that more markers of a given color be drawn to fill in each color of the longer rows.

The present color game may include a series of different embodiments, including different numbers of rows for the triangular player board configuration; different board or card shapes and patterns of colored rows; and randomizing of colors in each row, as well as between rows. While highly contrasting, primary colors, as well as black, white, and a basic neutral (e.g., brown), are preferred for the colors of the present game, it will be seen that any colors, hues, tints, or shades may be used as desired. Moreover, play need not end with the determination of a single winner, but may continue as subsequent players continue to fill in their game cards or boards. This may continue until some predetermined number of players have successfully filled in their cards, or until all players have completed their cards, as desired.

Accordingly, it is a principal object of the invention to provide a color game, in which players attempt to match each of the colored positions on their game cards or boards with corresponding colors called by a caller for the game.

It is another object of the invention to provide such a color game having a series of game cards or boards, with each of the cards differing from one another in their color patterns and with each player being provided a different board or card.

It is a further object of the invention to provide such a color game in which the player game cards of the primary embodiment each comprise a triangular matrix of color position rows, with each row having a different number of colored positions therein, and with all positions in a given row, comprising the same color.

Still another object of the invention is to provide various alternative embodiments for such a color game, such as different player card or board configurations having different color position configurations and numbers of rows thereon; randomizing color positions in each row, as well as between rows; providing colors, tints, hues, and/or shades other than primary colors and basic neutrals; and continuing the game for subsequent players after a first winner has been determined.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a color game, in which a caller calls out the names of colors randomly drawn in sequence, and players attempt to match those colors by placing markers on correspondingly colored positions on their individual playing boards or cards. Each player has a unique card or board, which differs from the cards or boards of all other players in the game. The first player to completely cover a predetermined area of his or her board (generally the entire board, but perhaps a smaller area, for shorter duration games) is the winner of the game.

The present color game may include a series of different game card embodiments. FIGS. 1A through 1H illustrate a series of eight different game boards or cards, which may be played or used by eight different players. The game cards of FIGS. 1A through 1H are designated as cards 10*a* through 10*h*, with each having a triangular configuration. Each card 10*a* through 10*h* includes a series of eight rows of colored positions, with the rows being designated as a first row 12*a* through 12*h*, the second row as 14*a* through 14*h*, and so forth, through the last row 26*a* through 26*h*, in the corresponding FIGS. 1A through 1H. Each of the color rows, e.g., rows 12*a* through 26*a* in FIG. 1A, contains at least one color position thereon or therein, e.g., color positions 13*a* through 27*a* for the corresponding rows 12*a* through 26*a* of FIG. 1A, positions 13*b* through 27*b* for rows 12*b* through 26*b* of FIG. 1B, etc., through positions 13*h* through 27*h* for rows 12*h* through 26*h* of FIG. 1H.

Each of the rows includes a different number of color positions thereon or therein, e.g., the first row 12*a*, 12*b*, etc. having only a single color position therein, the second row 14*a*, 14*b*, etc. having two color positions, etc., through the eighth row 26*a*, 26*b*, etc., which contains the maximum number of eight color positions for the embodiment of FIGS. 1A through 1H. The various game cards 10*a* through 10*h* of the corresponding FIGS. 1A through 1H, differ only in the specific color of each row of color positions on each of the boards or cards, in order to provide the required individuality between cards such that only a single card will be capable of winning at any call or play of the game.

Figure 1A:
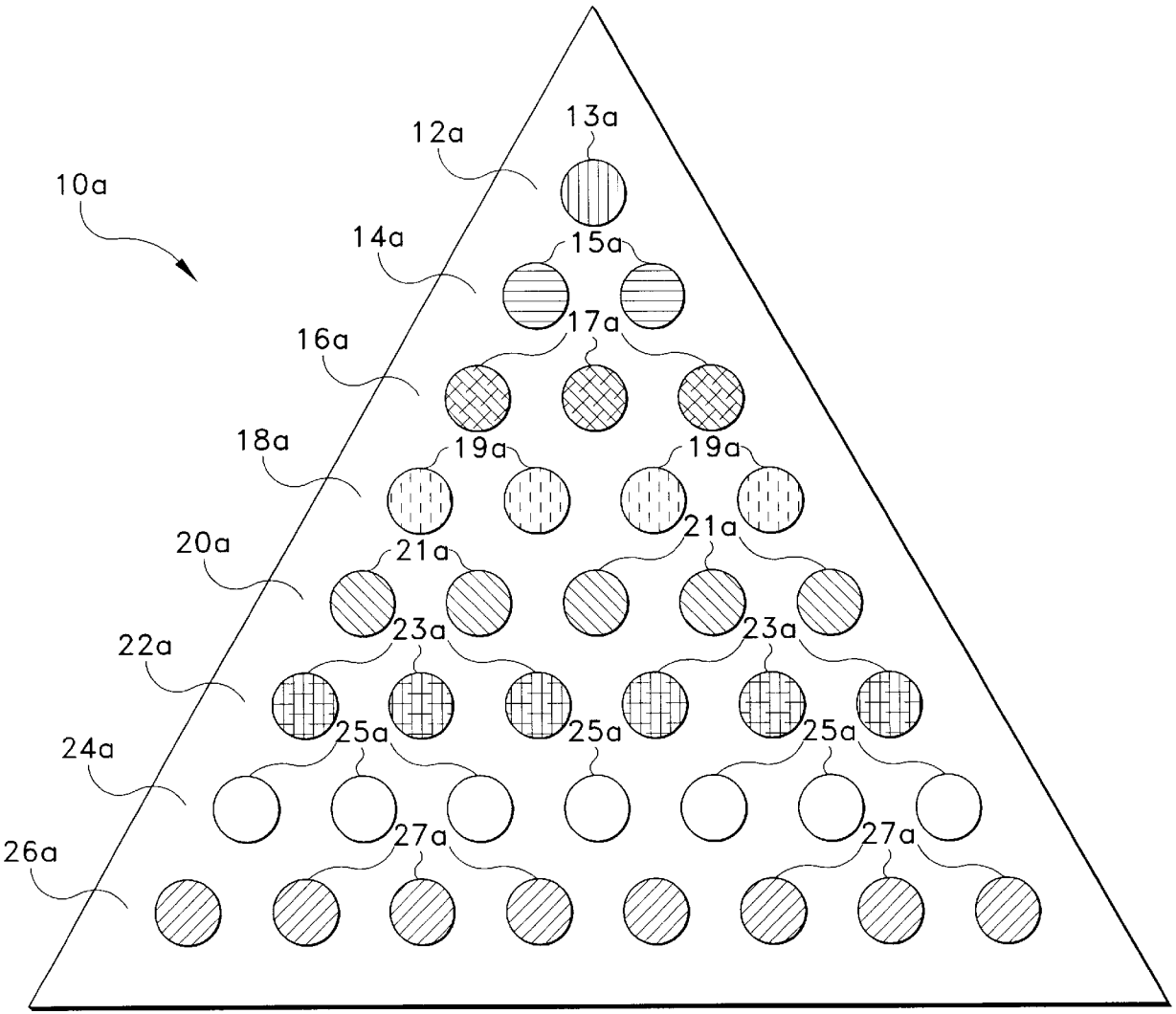
FIG. 1A is a first embodiment of a game board layout for a color game according to the present invention, showing the color pattern layout thereon.

Moreover, each of the color positions in any given row of each card or board are colored identically. As an example, the eight color positions 27*a* of the longest or last row 26*a* of the card 10*a* of FIG. 1A are each identically colored brown (or other neutral color) . The seven positions 25*a* of the next to last row 24*a* of the card 10*a* are each black (designated by the lack of shading in those positions on the card 10*a* of FIG. 1A). This arrangement continues up the card 10*a*, with each corresponding color position of the successive rows being colored yellow, green, violet, orange, blue, and the single color position 13*a* of the first row 12*a* being colored red.

Figure 1B:
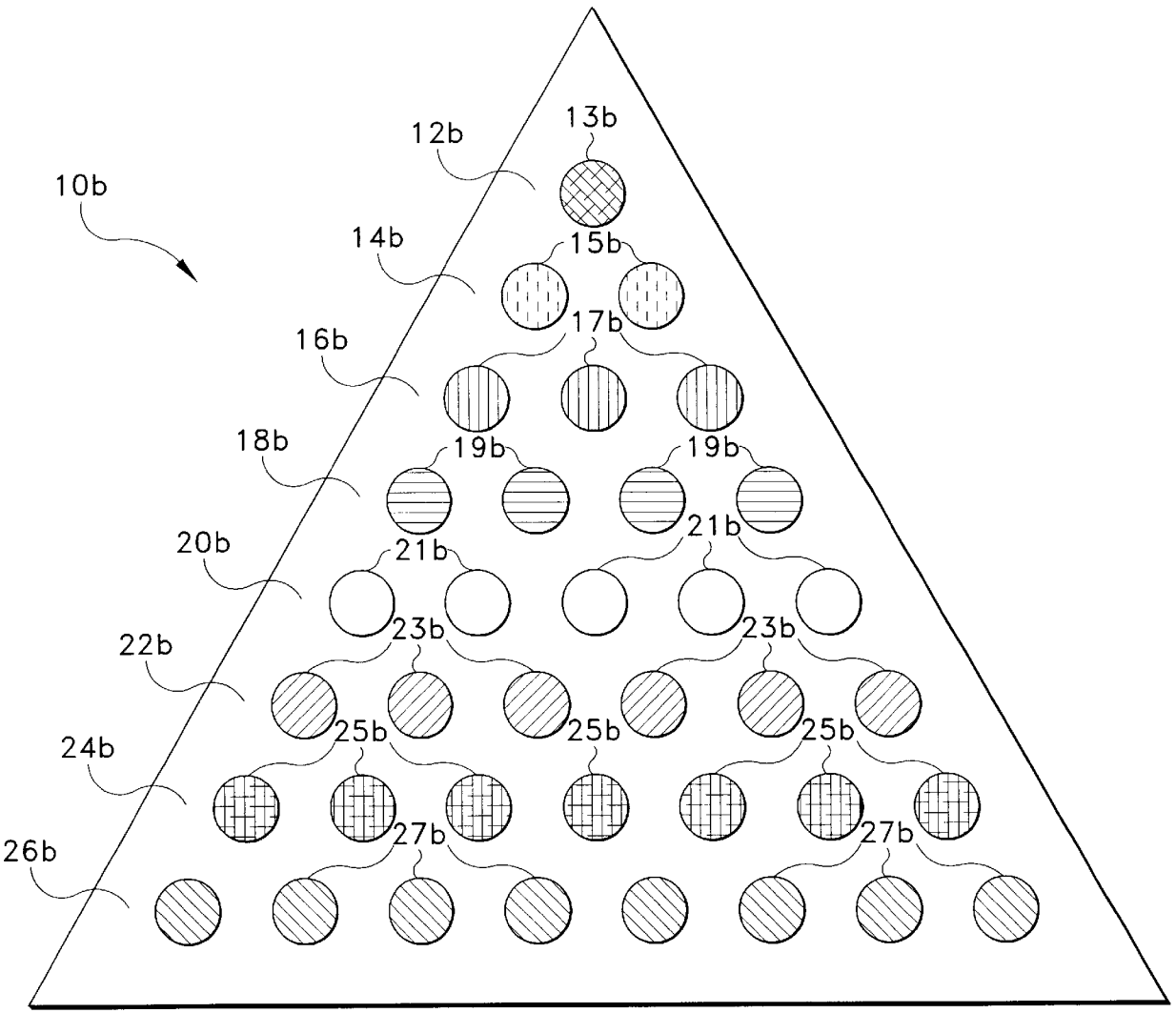
FIG. 1B is a second embodiment of a game board layout for a color game according to the present invention, showing a different color pattern layout from the game board of FIG. 1A.

The game card 10*b* of FIG. 1B also contains eight color position rows, designated as rows 12*b* through 26*b*. The number of color positions in each row, and the number of rows, is identical to the card 10*a* of FIG. 1A, described above. As in the case of the color positions of the rows forming the card 10*a* of FIG. 1A, the color positions within each of the rows 12*b* through 26*b* of the card 10*b*, are identical to one another. However, the colors of each of the rows are different from one another. In the case of the card 10*b* of FIG. 1B, the eight color positions 27*b* of, the final row 26*b* are each colored green, with the seven color positions 25*b* of the row 24*b* immediately above being colored yellow, the six positions 23*b* of the next higher row 22*b* being colored brown, etc., through black, blue, red, violet, and finally, the single color position 13*b* of the first row 12*b*, is colored orange.

The same process continues for the other cards 10*c* through 10H of FIGS. 1C through 1H. It will be seen that the colors are not critical, so long as each of the positions in a given row are identically colored to one another, and so long as each card contains rows which are colored differently from the rows of other cards. It will be seen that the color positions of any given row of each of the cards 10*a* through 10*h*, are colored differently from the positions of the corresponding row of each of the other cards. As an example, the five color positions 21*a* of the fifth row 20*a* of the card 10*a* are colored green, with the corresponding five positions of the fifth rows 20*b*, 20*c*, 20*d*, 20*e*, 20*f*, 20*g*, and 20*h*, respectively being colored black, orange, violet, yellow, brown, red, and blue. This arrangement continues for the color positions of each of the corresponding rows of each of the cards 10*a* through 10*h*, with each row having one or more identically colored positions, but of a different color from those positions of other corresponding rows containing an equal number of color positions.

Figure 1C:
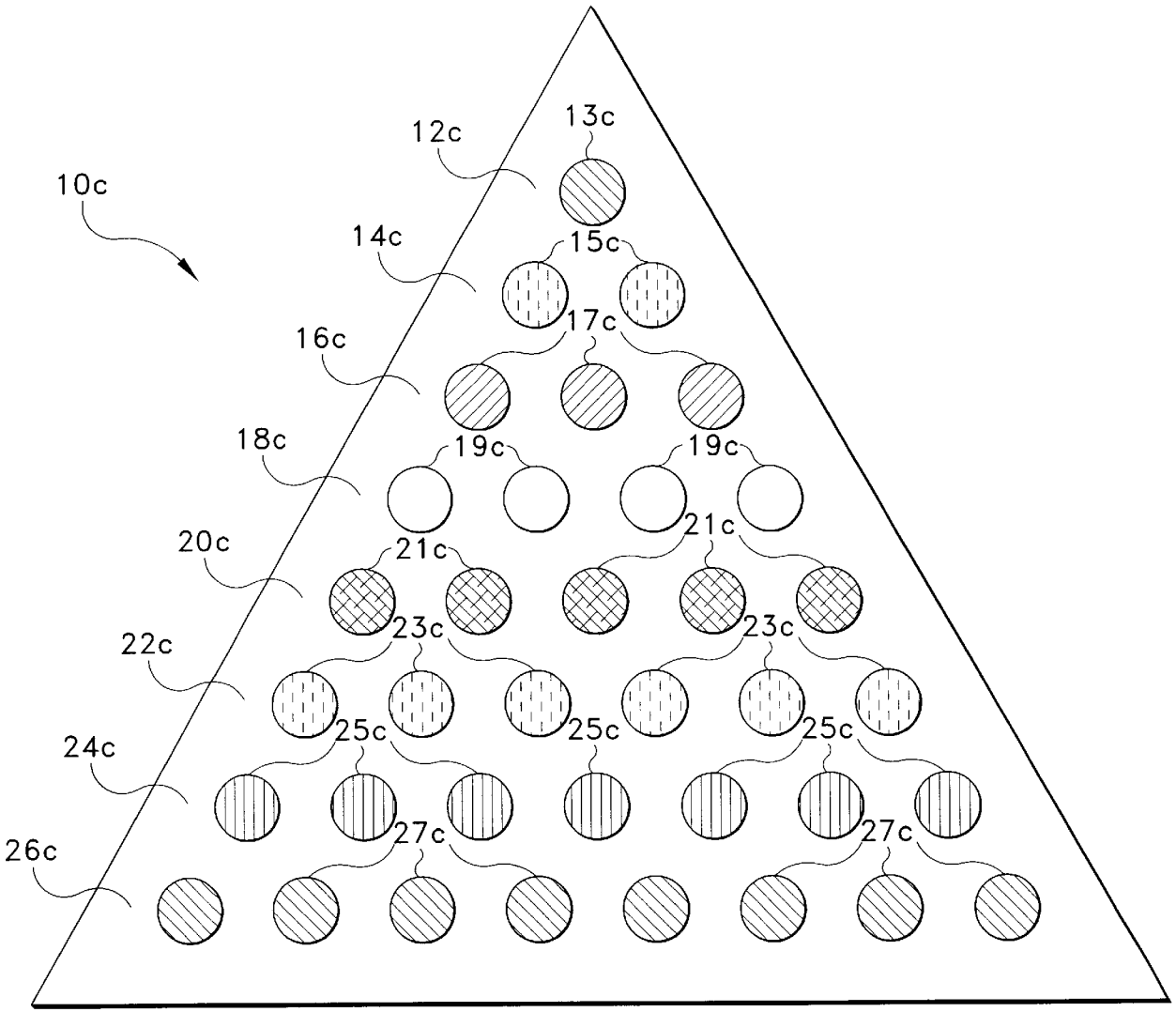
FIG. 1C is a third embodiment of a game board layout for a color game according to the present invention, showing a different color pattern layout from the game boards of FIGS. 1A and 1B.
Figure 1D:
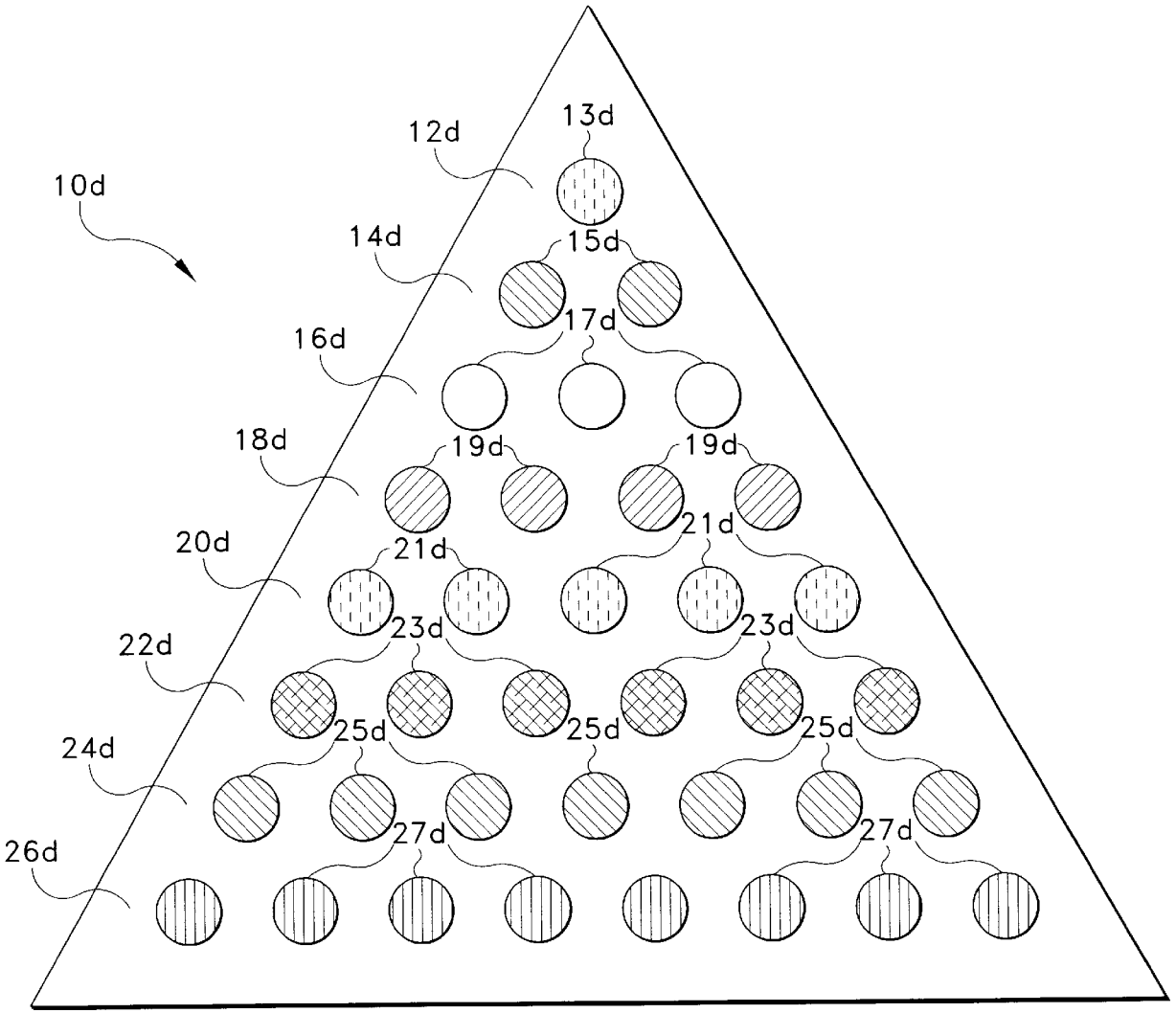
FIG. 1D is a fourth embodiment of a game board layout for a color game according to the present invention, showing a different color pattern layout from the game boards of FIGS. 1A through 1C.
Figure 1E:
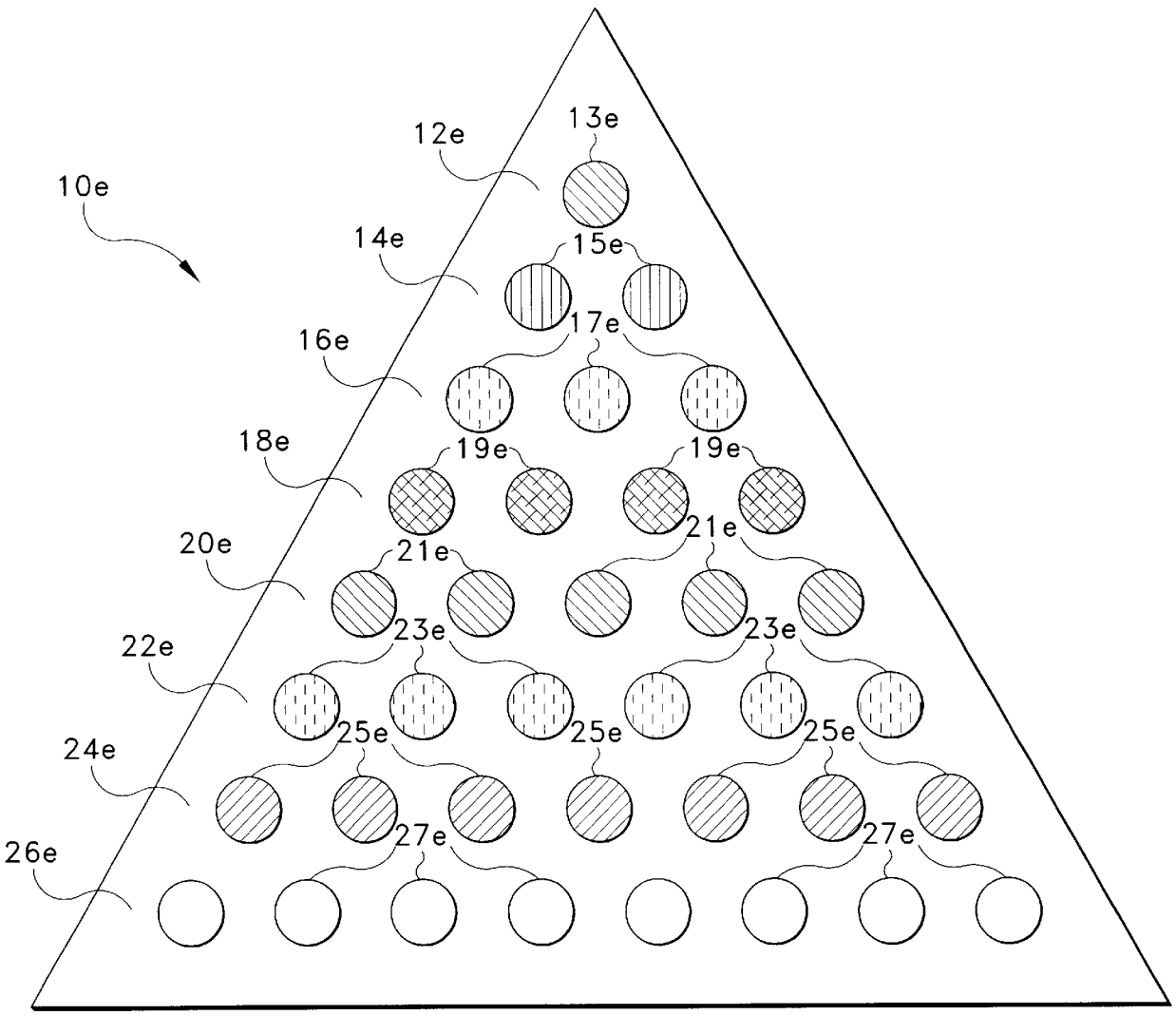
FIG. 1E is a fifth embodiment of a game board layout for a color game according to the present invention, showing a different color pattern layout from the game boards of FIGS. 1A through 1D.
Figure 1F:
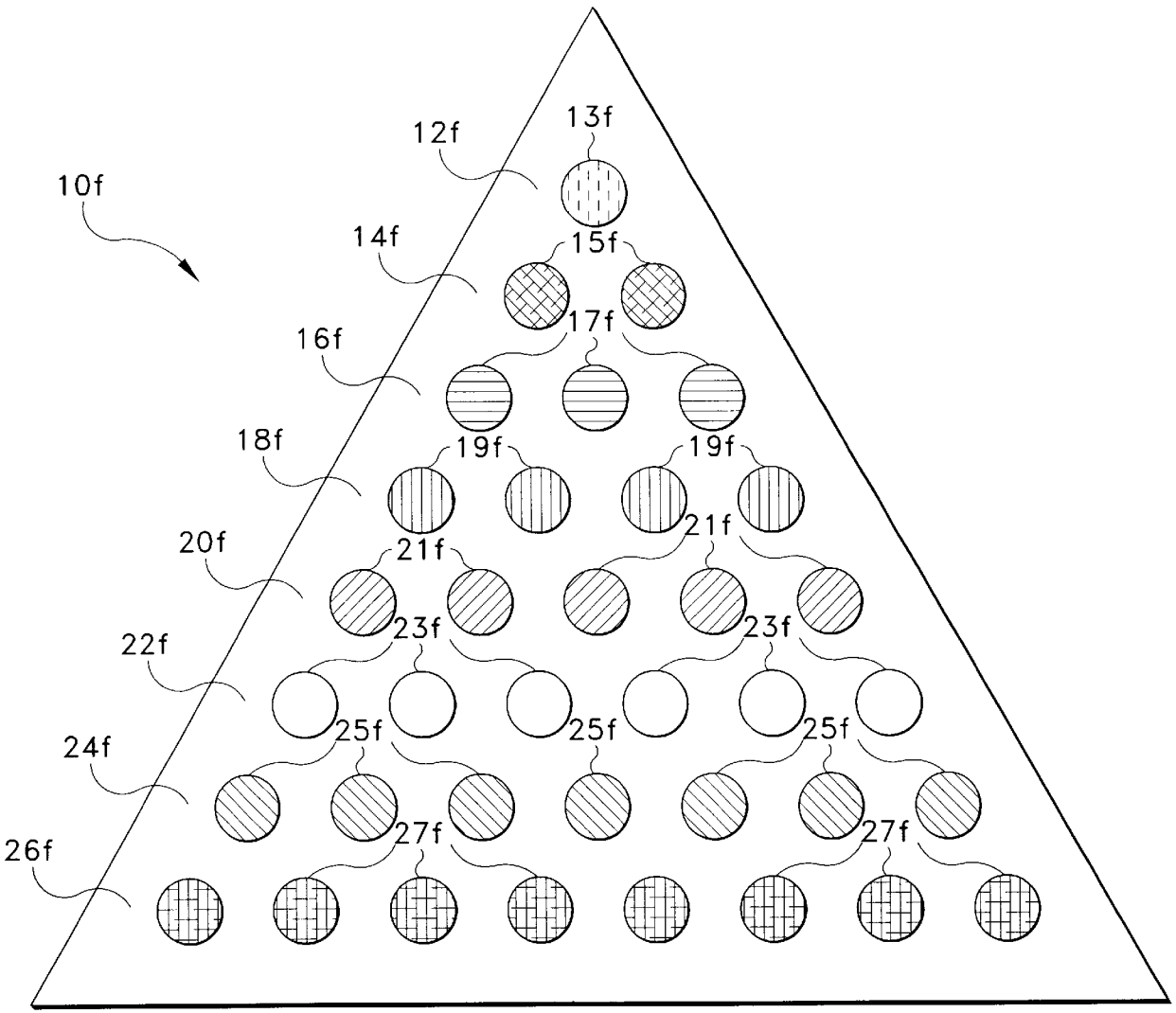
FIG. 1F is a sixth embodiment of a game board layout for a color game according to the present invention, showing a different color pattern layout from the game boards of FIGS. 1A through 1E.
Figure 1G:
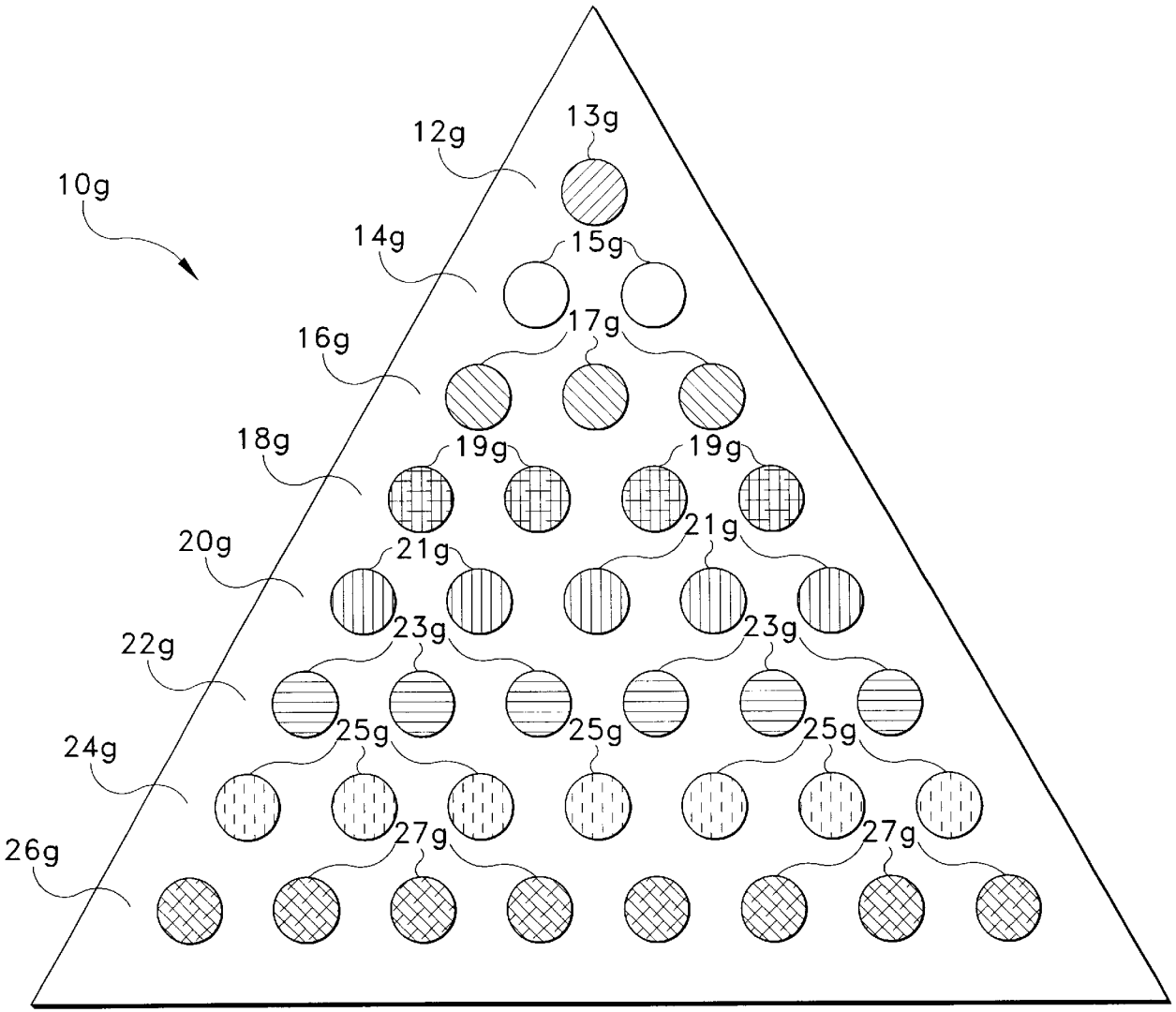
FIG. 1G is a seventh embodiment of a game board layout for a color game according to the present invention, showing a different color pattern layout from the game boards of FIGS. 1A through 1F.
Figure 1H:
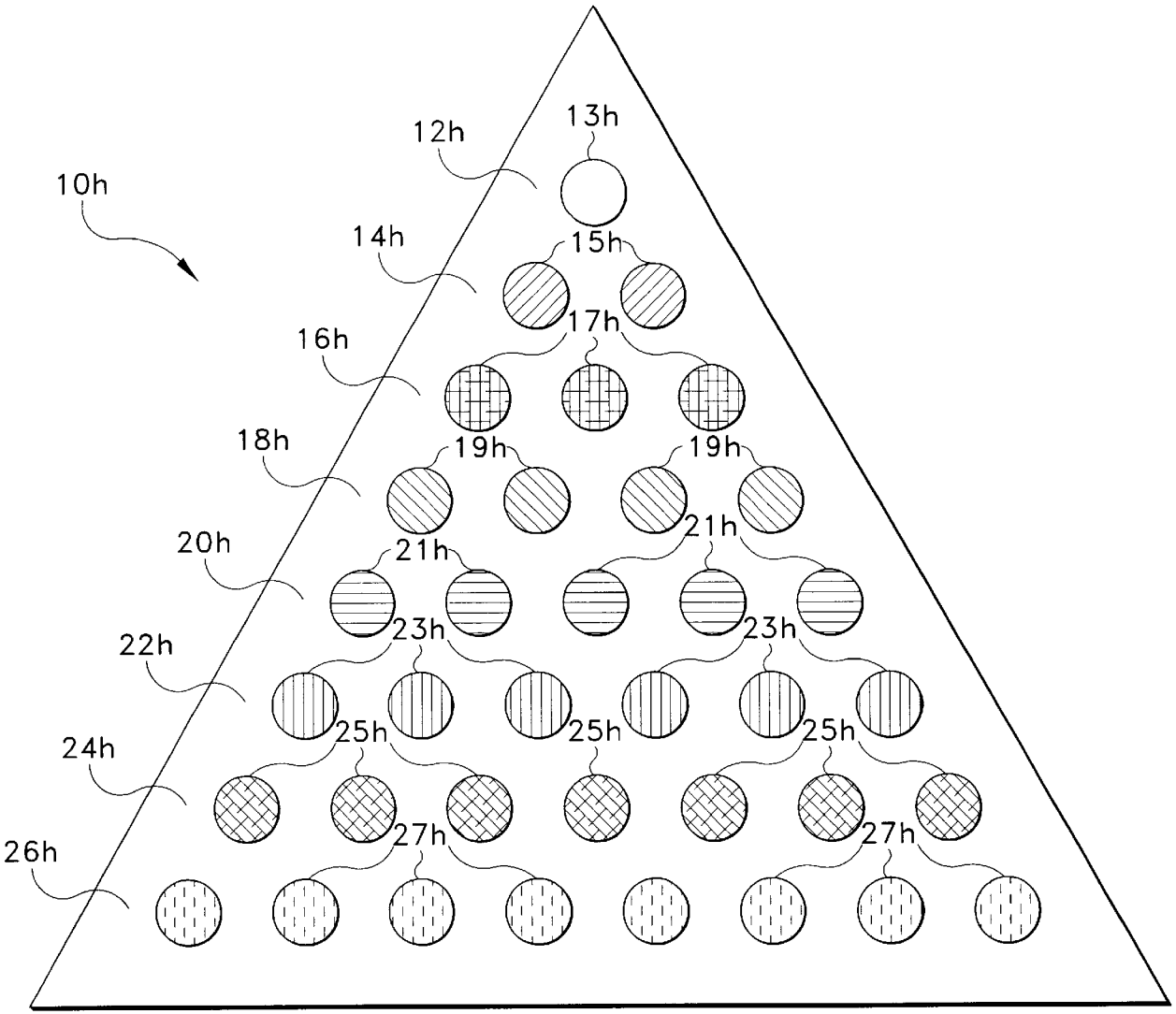
FIG. 1H is an eighth embodiment of a game board layout for a color game according to the present invention, showing a different color pattern layout from the game boards of FIGS. 1A through 1G.

This arrangement results in one of the cards (e.g., the first card 10*a*, of FIG. 1A) having only a single red color position (i.e., the single color position 13*a* of the first row 12*a*) thereon, while card 10*b* of FIG. 1B has three such red color positions 17*b* in its third row 16*b*, card 10*c* of FIG. 1C has seven such red positions 25*c* in its seventh row 24*c*, etc. Thus, each player will require a different number of color callouts to complete a given, correspondingly colored row of color positions of his or her card.

This randomizes the game, as is desired, as one player may be able to complete a relatively short row of color positions on his or her card, while another player still has some identically colored color positions remaining uncovered on a longer row of his or her card. As the caller draws or selects colors at random, a greater number of some colors will be drawn than others, due to chance. While many of these color calls will be useful to many or most of the players, others will find that their shorter rows are already filled in, and that they do not need additional identical colors. Thus, some players will find most of their rows filled in by the end of the game, but a single player, needing only one more color to fill in a last color position in one last row, will finally be successful when that color is called by the caller.

Figure 1I:
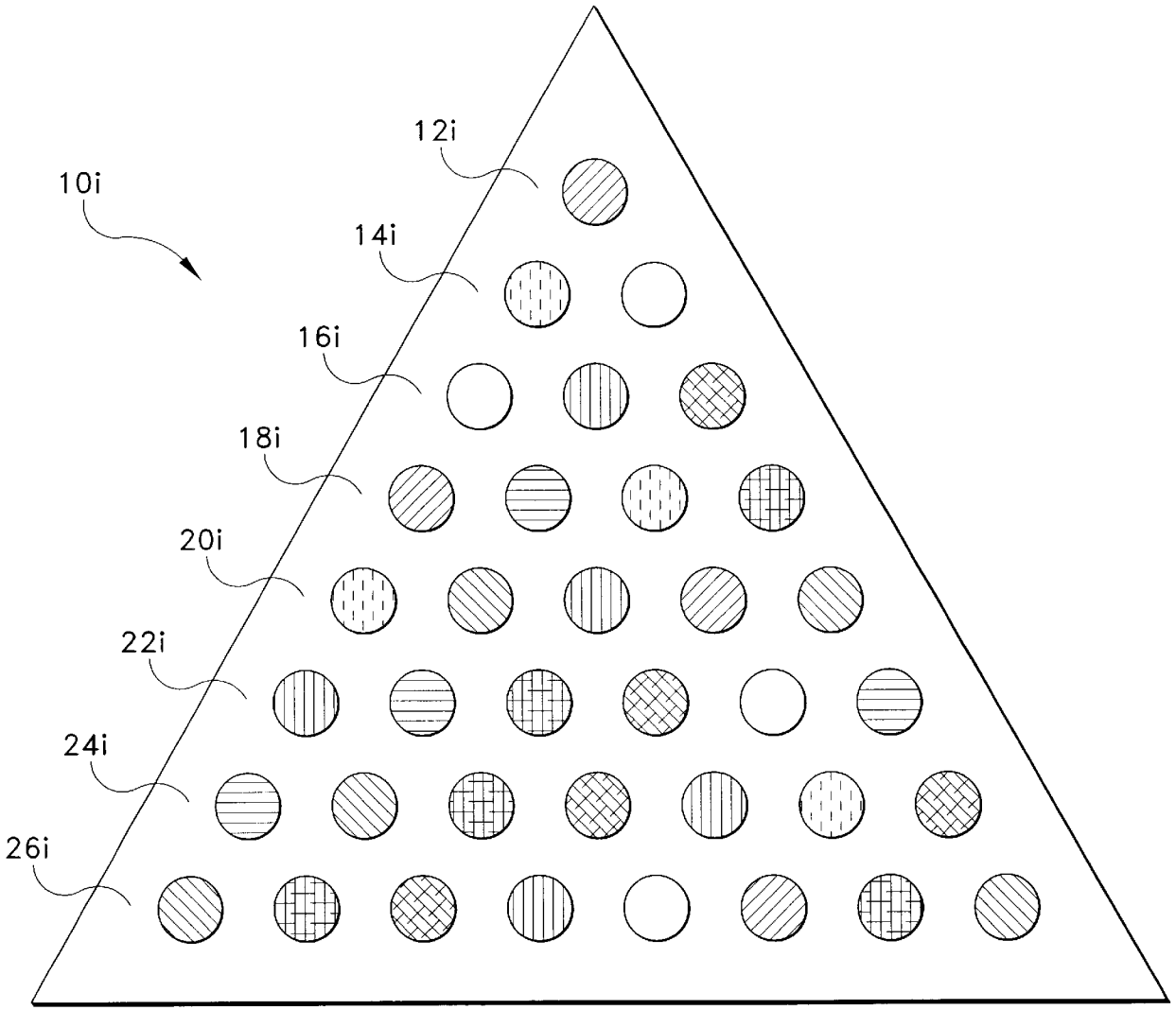
FIG. 1I is a ninth embodiment of a game board layout for a color game according to the present invention, showing a different color pattern layout from the game boards of FIGS. 1A through 1H.

An alternative game card 10*i* is illustrated in FIG. 1I of the drawings. Rather than each row containing identically colored positions, as in the game cards 10*a* through 10*h*, the color positions of each of the rows 12*i* through 26*i* of the game card 10*i* are completely randomized, with the various color positions of any given row, being colored differently from one another. While two color positions in a given row may be colored identically (e.g., the yellow positions of the second and seventh positions of the eighth row 26*i*), this is not required, nor is any identical coloring required for any of the color positions in any given row of the game card 10*i*. Such randomized card patterns will be randomized differently from one another, in order to provide only a single first player completing coverage of all positions.

Figure 2:
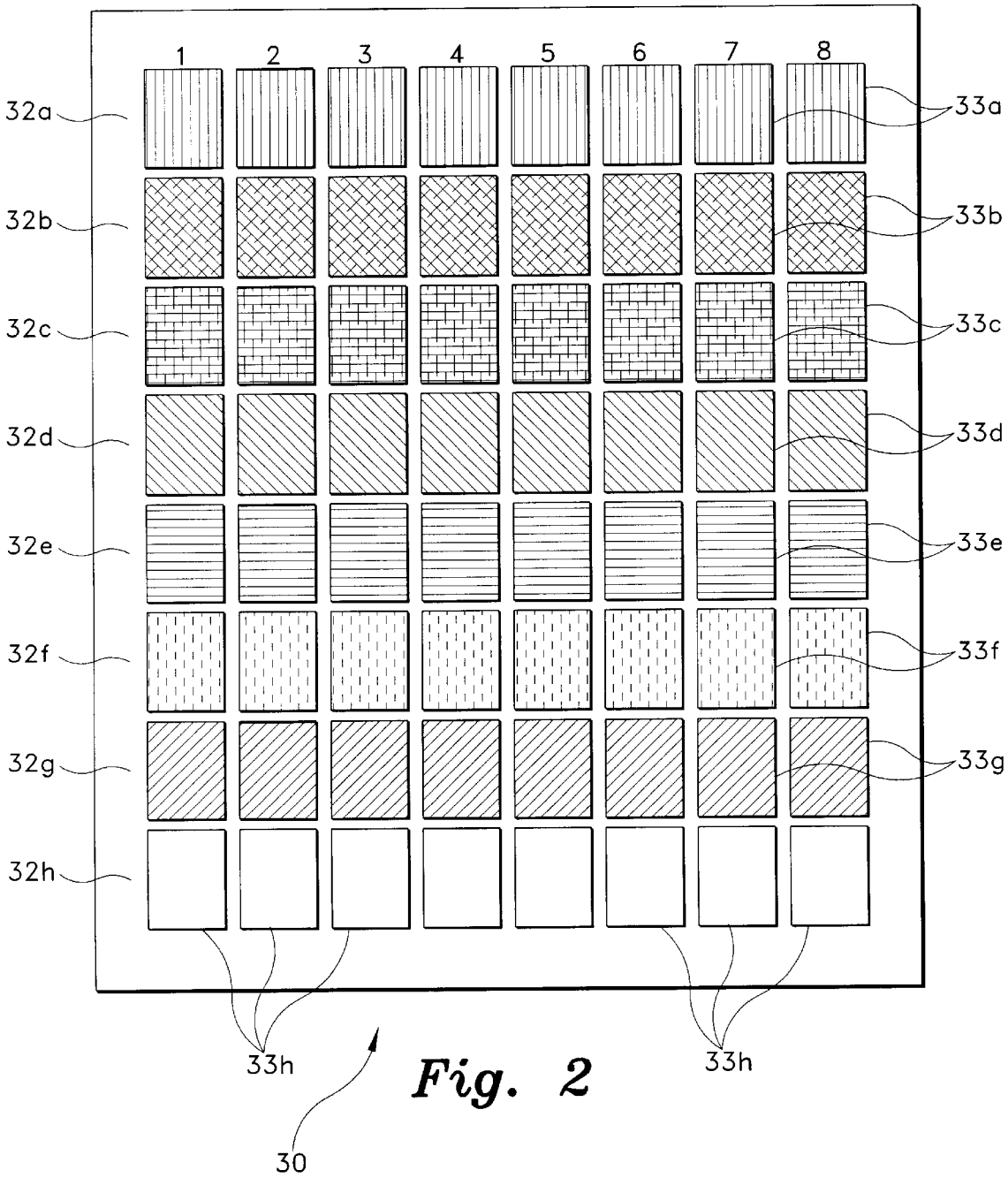
FIG. 2 is a plan view of a master board for the present color game, showing an exemplary color pattern placement thereon.

FIG. 2 illustrates the caller board 30 used with the game cards 10*a* through 10*h*. The caller board 30 includes a series of color rows 32*a* through 32*h*, corresponding to the number of player cards 10*a* through 10*h* of FIGS. 1A through 1H. Each of the rows 32*a* through 32*h* contains a series of eight color positions, designated as 33*a* through 33*h*, with each lower case letter corresponding to the same letter of the corresponding row 32*a* through 32*h*. These color positions 33*a* through 33*h*, correspond to the color positions of each of the boards 10*a* through 10*h*. Each of the color positions in any given row are identically colored, with the colors of the positions in different rows, differing from one another, similarly to the configurations of the game cards 10*a* through 10*h*.

However, eight color positions are required for each of the rows 32*a* through 32*h*, as each of the game cards 10*a* through 10*h* has one row with a maximum of eight identical color positions. Thus, the eight red positions 33*a* of the first row 32*a* of the caller board 30, are sufficient to correspond to the eight red positions of the game card 10*d* of FIG. 1D, the eight yellow positions 33*b* of the second row 32*b* of the board 30 correspond to the eight yellow positions of the game card 10*f* of FIG. 1F, etc., for each of the eight colors provided. In other words, each game card 10*a* through 10*i* contains only thirty six positions, due to the decreasing number of positions in each row from the last to the first row. However, the caller board contains an eight by eight matrix of sixty four color positions, defining eight differently colored rows, with each row containing eight identically colored positions.

Figure 3:
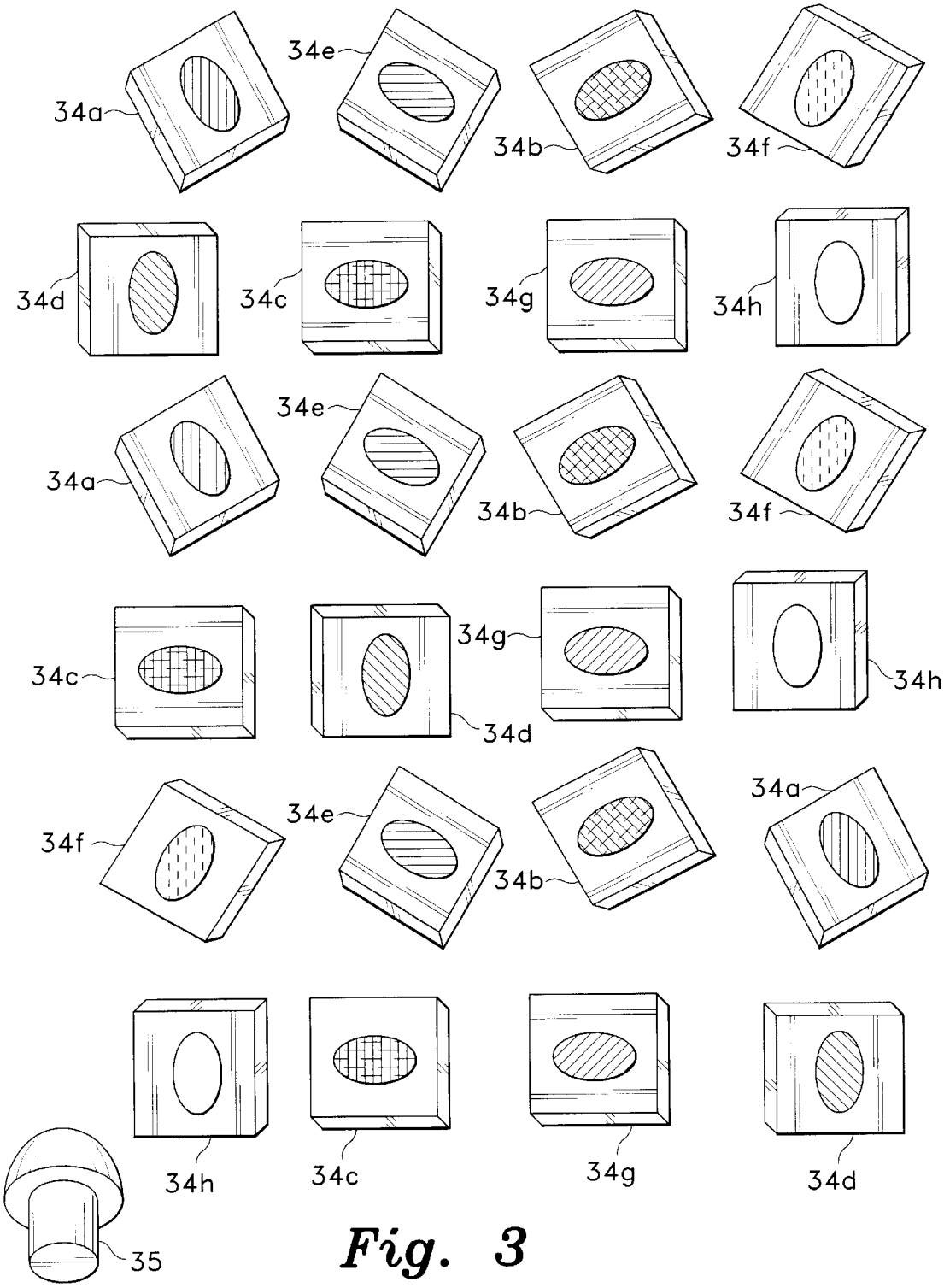
FIG. 3 is a perspective view of a series of differently colored playing markers for placement on the master board, and a single exemplary one of the markers used by players for placement upon individual game boards of the present color game invention.

FIG. 3 of the drawings illustrates a plurality of color position markers or tiles which are used by the caller for placement upon each correspondingly colored position of the caller board as those colors are called. FIG. 3 also illustrates a single exemplary player marker, a plurality of which may be used by the players to cover the color positions of their cards as the caller calls out those colors during the game.

The specific shape or configuration of these markers is not critical to the play of the present color game. The markers used by the caller may be square or rectangular tiles of wood, plastic, or other suitable material as desired, to correspond with the shapes of the individual color positions 33*a* through 33*h* of the caller board 30, if so desired. These caller markers may be identically colored over most of their surfaces, with a series of differently colored spots or dots corresponding to the colors of the rows of the caller board provided upon at least one surface thereof. Alternatively, they may have some other shape or configuration, and/or be uniformly colored to correspond with the colors of the rows of the caller board.

The markers used by the players may be small, short, cylindrical buttons or the like, formed of wood, plastic, or other suitable material, generally as shown in FIG. 3, or may comprise small pegs which may be placed upon the colored positions of the player cards during play. Preferably, the player markers are plain and uncolored, as they are used only to mark colors on the player board as called out by the caller. However, they may be colored, if so desired, with players required to match colors as called.

The players and caller are each provided at least a sufficient number of color position markers to cover all of the positions of their playing cards or caller card, as appropriate. The caller markers are colored with each of the eight colors used with the player cards 10*a* through 10*h* of FIGS. 1A through 1H and the caller board 30 of FIG. 2. The caller markers of FIG. 3 are designated as markers 34*a* through 34*h* and are respectively colored red, orange, yellow, green, blue, violet, brown, and black, corresponding to the colors of the respective color positions 33*a* through 33*h* of the corresponding rows 32*a* through 32*h* of the caller board 30 of FIG. 2, and thus to the corresponding colors used for the player cards.

Each player is provided with a plurality of player markers sufficient to cover all of the positions of his or her player card or board, as exemplified by the single player marker 35 illustrated in FIG. 3. All of these markers 35 are identical, so only a single such marker 35 need be illustrated in the drawings. Alternatively, a slightly more advanced and complex variation of the present game may provide a plurality of different colored markers for each of the players, with players being required to select a correspondingly colored marker for placement upon each of the color positions of their cards as the corresponding color is called by the caller. Such differently colored player markers may be essentially the same as the caller markers 34*a* through 34*h* illustrated in FIG. 3. This variation is not preferred, as it requires that players sort out the appropriately colored markers and adds a level of complexity to the game which may not be desirable for very young players. Moreover, as such markers are handled by young children, some loss is to be expected, and the identical, uncolored player markers preferred for use in the present game, are easily replaced as needed.

Figure 4:
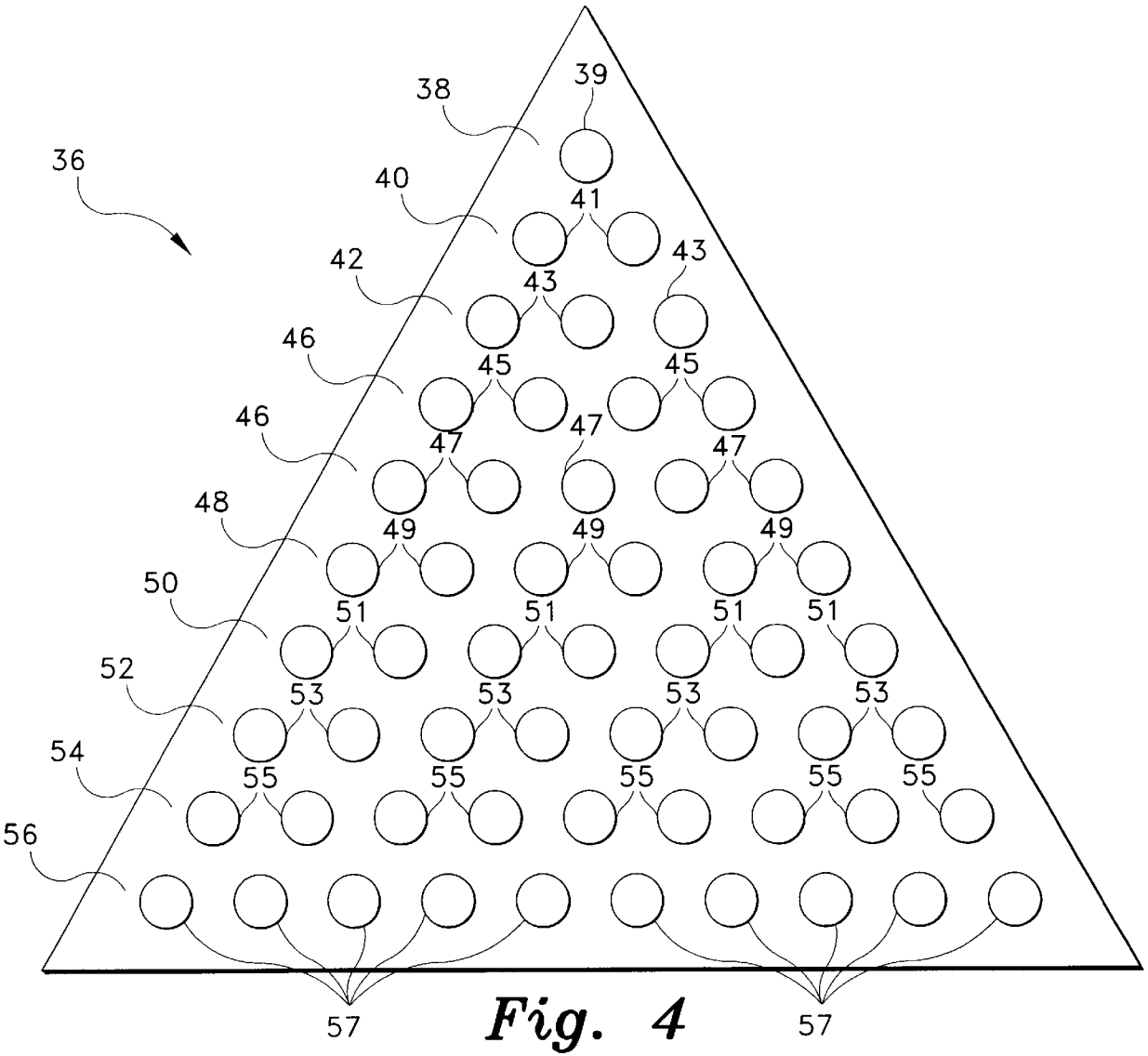
FIG. 4 is an alternative game board layout having a triangular matrix of playing positions with ten positions along each side.

Other alternative player card and corresponding caller board configurations may be used with the present color game, if so desired. FIG. 4 illustrates an alternative player card 36, having a series of ten color position rows 38 through 56. Each row has at least one color position therein, with the first row 38 having a single color position 39, the second row 40 having two color positions 41, the third row 42 having three color positions 43, etc., through the tenth row 56 which contains ten color positions 57 thereon. While no color or shading is shown for the various color positions 39 through 57 of the ten row player card 36 of FIG. 4, it will be apparent that the color positions contained within any given row may be identical to one another, with the colors differing between rows, as in the eight row cards 10*a* through 10*h* of FIGS. 1A through 1H, or the positions may be colored randomly or in some other pattern as desired.

Figure 5:
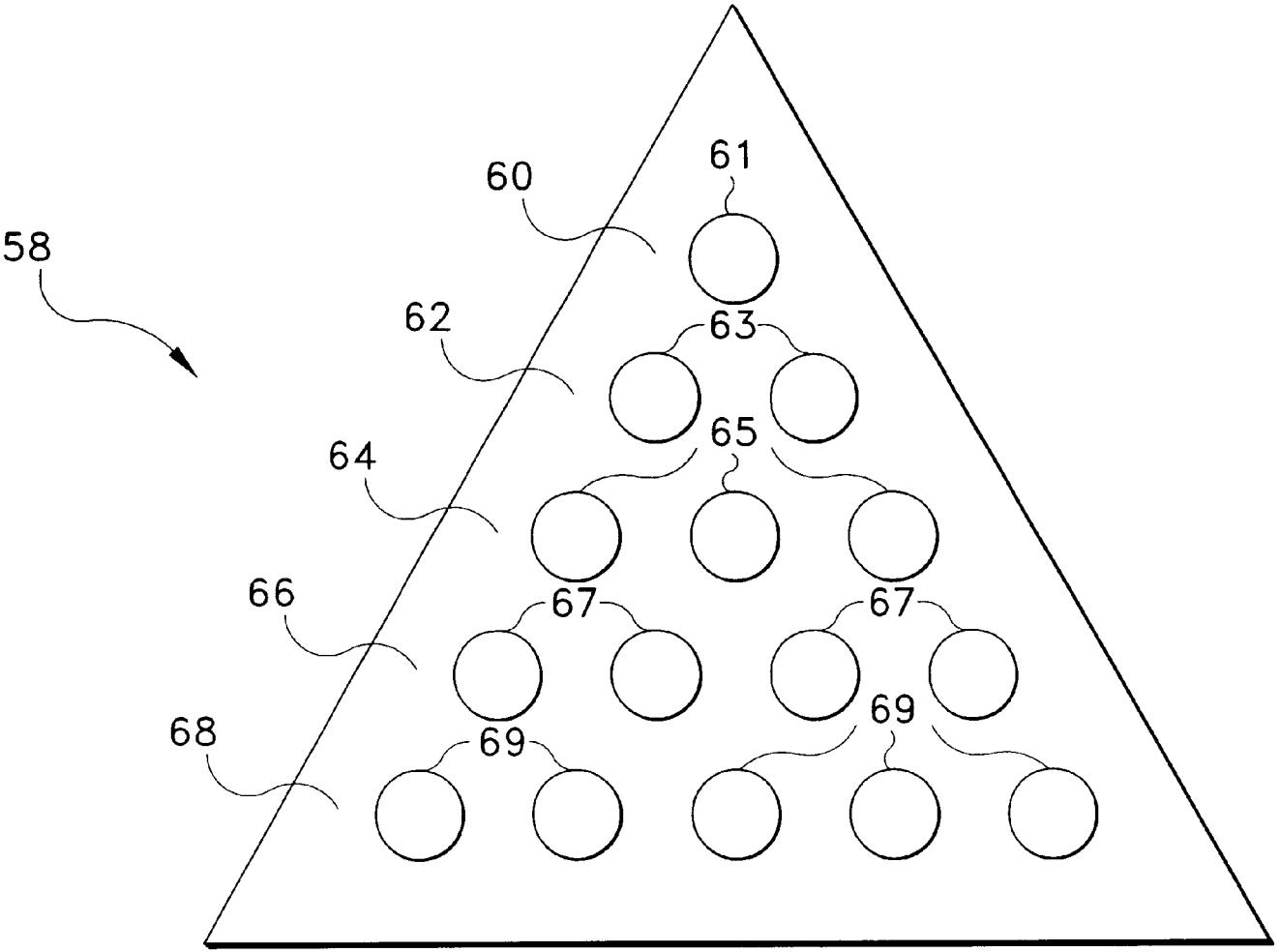
FIG. 5 is another alternative game board layout having a triangular matrix of playing positions with five positions along each side.

FIG. 5 illustrates a further alternative, comprising a player board 58 having a triangular array of color positions arranged in a series of five rows, designated as rows 60 through 68. Each of the rows 60 through 68 contains at least one color position, with the first row 60 having a single color position 61, the second row 62 containing two color positions 63, etc., through the fifth row 68 which contains five color positions 69. Again, each row may contain a series of identically colored positions, with the colors differing from row to row, or may be colored randomly or in some other pattern as desired.

The ten row player card embodiment of FIG. 4 provides a somewhat more complex color game for perhaps more advanced players, if so desired obviously, two more colors in addition to the eight colors used in the player cards 10*a* through 10*h* of FIGS. 1A through 1H are required for the ten row card of FIG. 4, with the more rows being provided on a single player card, also requiring more different colors. This may be achieved through different shades of colors, different finishes (flat, gloss, etc.), or other visual distinction, as desired. A corresponding caller board containing ten rows of ten color positions each, is used with the ten row player card of FIG. 4. Alternatively, the five row player card of FIG. 5, provides a simpler game for less advanced players. The caller card used with such a five row card, need only contain twenty five positions in a five row by five position matrix.

Figure 6:
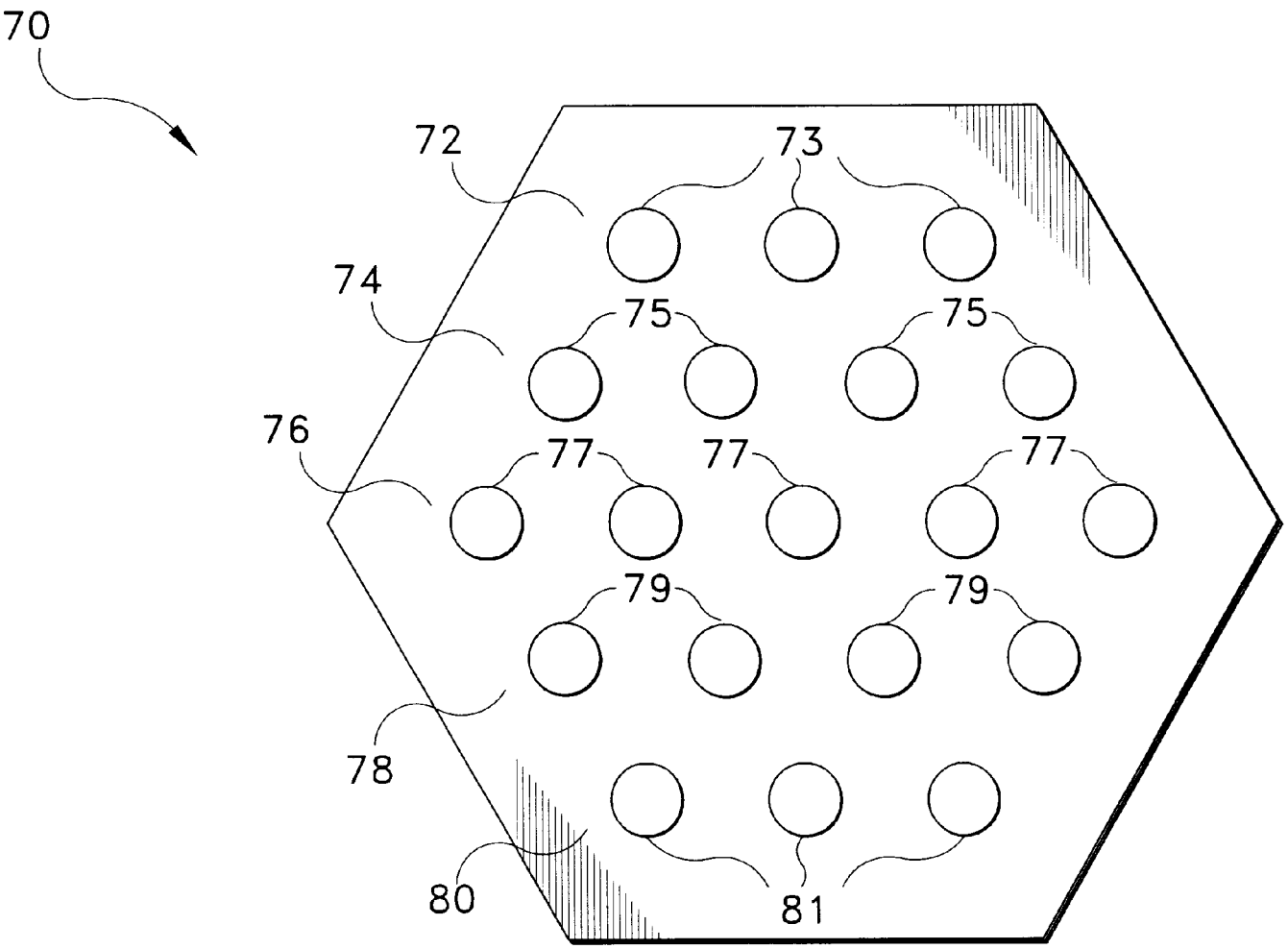
FIG. 6 is another alternative game board layout having a hexagonal matrix of playing positions with three positions along each side.

FIG. 6 provides an illustration of yet another player card embodiment, comprising a hexagonal card 70. The card 70 contains a series of five rows, designated as rows 72 through 80, with the first and last rows 72 and 80 each having three color positions, respectively 73 and 81, the second and fourth rows each having four color positions, respectively 75 and 79, and the third or central row having five color positions 77. This pattern will be seen to provide a hexagonal matrix for the player card 70. As in the other player cards of the present color game, the colors may be the same in any given row, with colors differing between rows, or may have some other pattern. The five by five caller board described with the five row triangular card 58 of FIG. 5, may also be used here.

Figure 7:
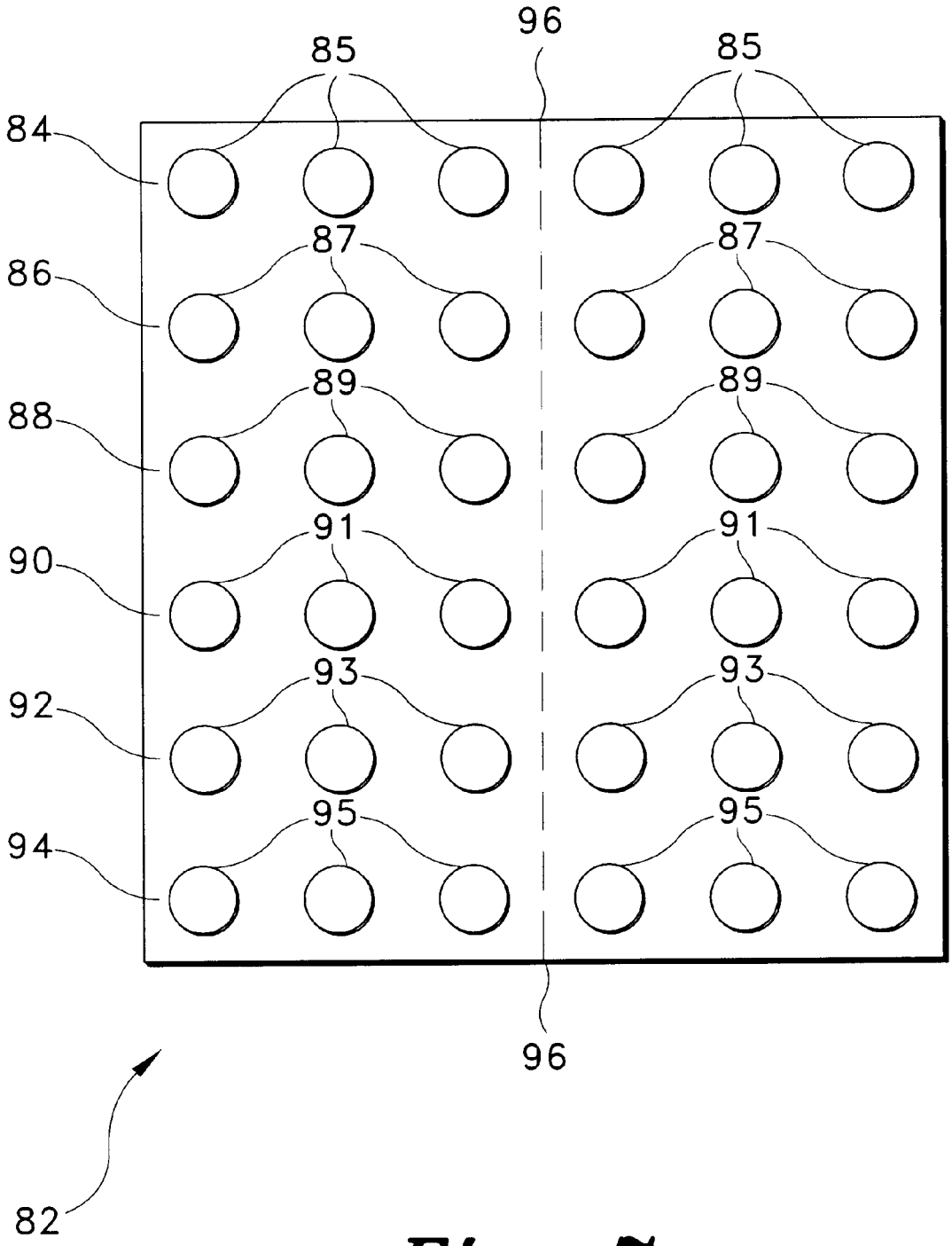
FIG. 7 is another alternative game board layout having a square matrix of playing positions with six positions along each side.

FIG. 7 illustrates another embodiment of the present game, comprising a square player card 82 having a series of six color position rows, respectively 84 through 94, thereacross. Each of the rows 84 through 94 contains a series of six color positions thereon, respectively designated as positions 85 through 95 for the six rows 84 through 94. A break line 96 is shown down the center of the card 82, indicating the division of the card 82 into two separate cards, each having only three color positions in each of the rows 84 through 94. As in the other player cards described further above, the color positions may be identically colored in each of the rows, with each of the rows having different colors from one another, or may be randomly colored or colored in some other pattern as desired. A caller board essentially identically configured to the player cards 82, may be used with those cards.

Figure 8:
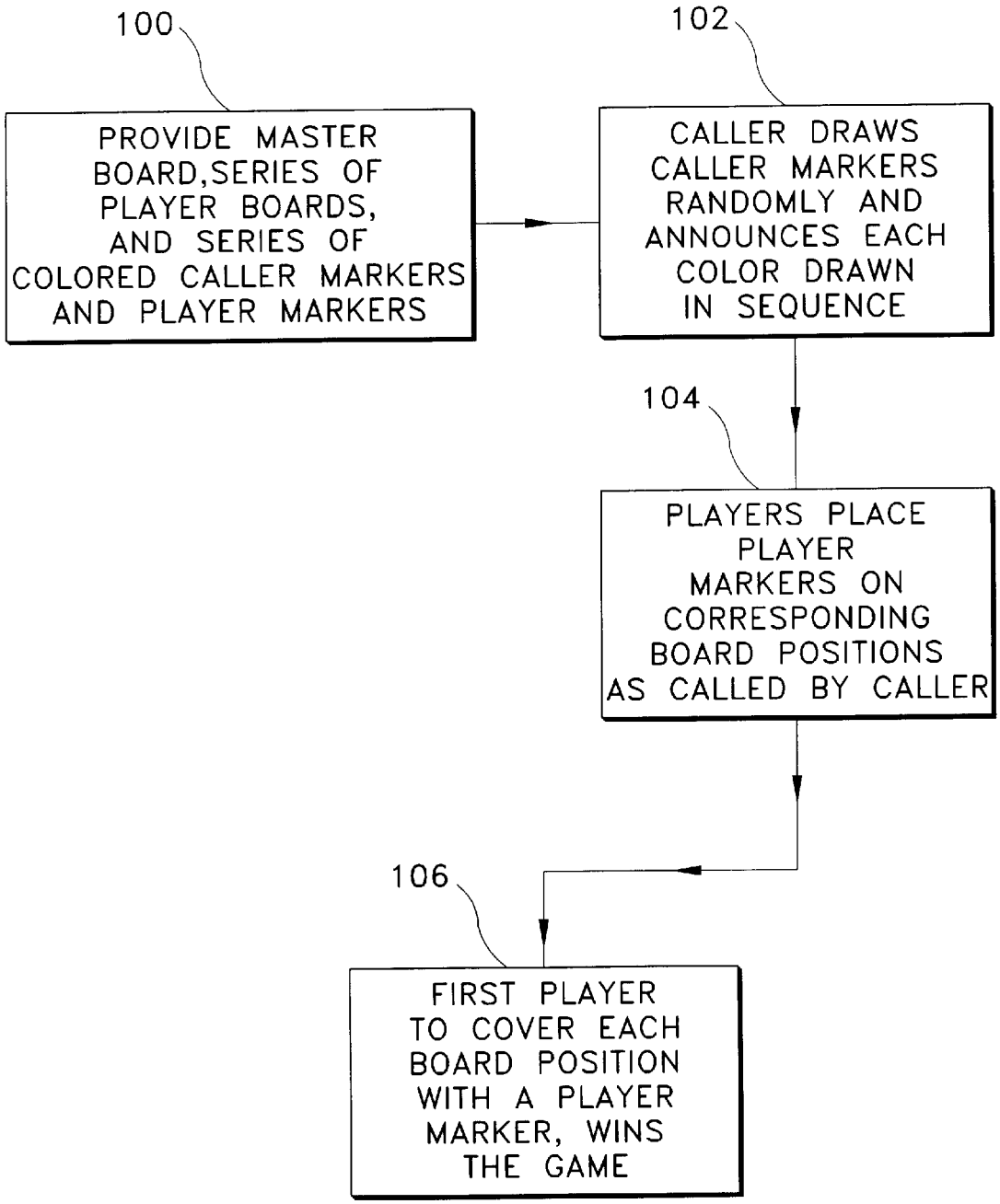
FIG. 8 is a flow chart showing the basic steps in the method of play of the present color game.

FIG. 8 provides a flow chart illustrating the basic steps in the method of play of the present color game. The game is initiated in accordance with the first step 100 of FIG. 8 by providing each of the players with a player or game card, such as the cards 10*a* through 10*h* of FIGS. 1A through 1H. Each player is given a number of markers 35 (or other markers) at least sufficient to cover each of the color positions of his or her card. The caller for the game is provided with a master board or caller board, e.g., the board 30 of FIG. 2 for the player cards of FIGS. 1A through 1H, and a corresponding number of markers, e.g. markers 34*a* through 34*h*, sufficient to cover the board.

A container (not shown) is also provided for the caller or master board markers, from which the caller may draw the board position markers singly in sequence during the course of play. The container may be a conventional can, bag or sack, etc., and is preferably opaque, so no one is able to see the colors of the board markers contained therein before they are removed. The board markers are placed in the container, and the caller then randomly draws the markers from the container, one at a time, and announces the color of each marker as it is drawn, generally in accordance with the second step 102 of FIG. 8. The marker may also be shown to the players, as its color is announced. Once the color of the selected marker has been announced, that marker is placed upon a one of the correspondingly colored positions of an appropriate row of the caller or master board 30, illustrated in FIG. 2.

Upon hearing and/or seeing the color of the marker drawn, players each select a marker from their individual supplies, and attempt to locate an open color position on their own cards which corresponds to the color just called by the caller, generally as indicated by the third step 104 of FIG. 8. For example, if a red master marker is drawn, the caller will announce "red," while showing the red marker to the players, and then place the marker on one of the red positions 33*a* of the first or red position row 32*a* of the master board 30. Each player will select one of their position markers 35 for placement upon a red position in one of the rows of his or her playing card.

As the game progresses, several markers of any given color will be likely to be drawn by the caller during the course of play. In a situation where perhaps three red markers have been drawn previously, with the above noted red marker being the fourth red marker to be drawn and called out, not all players will be able to play such a marker. For example, the player holding the first player card 10*a* of FIG. 1A, with its single red position 13*a* of the first row 12*a*, can only play a single red marker, and must pass on any subsequent red markers called. The player holding the sixth player card 10*f* of FIG. 1F, will find that the fourth red marker drawn and called will just complete the fourth row 18*f*, with its four red positions 19*f* thereon. A player holding the fourth card 10*d* of FIG. 1D, with its eight red positions 27*d* along the bottom row 26*d* of the card, will find that an additional four empty or uncovered red positions 27*d* still remain after the first four red markers have been drawn and called. Thus, the different color arrangements of each player card assure that the color positions of each card will be covered at different rates during play.

In a preferred embodiment of the present color game, the object is to be the first player to completely cover all of the playing positions of his or her card, as indicated by the final step 106 of FIG. 8. The first player to do so announces this achievement (e.g., by calling "Colored it"), and wins the game. Again, only a single player will achieve this goal at any given turn of play, due to the different configurations of each of the player cards.

The present color game provides alternative scenarios or rules of play, as well. For example, an abbreviated game may be played, in which the object is to cover some predetermined number of color positions of each player board. If time is limited, the instructions may be to cover at least three (or some other number) positions on the board, or perhaps to completely cover only three (or some other number) of the possible colors provided in the game. This still maintains the effect provided by the different color combinations and numbers of positions of any given color, on each player card. While this is disadvantageous to the player holding the card with one of the preselected colors comprising the longest row of the card, the "luck of the draw" will balance out over several plays. Another alternative is to attempt to form a predetermined pattern on the card, e.g., attempting to place a marker upon each of the peripheral positions of the card. Yet another alternative is to play to a predetermined time limit, where only a specific time duration is available. In this case, a player having the greatest number of positions covered, is the winner of the game.

The present color game also provides for the determination of second through lower finishing positions, as well, particularly in the preferred game where the object is to cover all of the positions of the card. In this case, after a first player has covered all of the positions of his or her card, play may continue until a second player reaches that goal, with play continuing as the third, fourth, etc. players finally reach that goal.

In conclusion, the present color game provides a novel and enjoyable means for teaching and enforcing color recognition among pre-literate, illiterate, and/or dyslexic players. The present game encourages the recognition of such colors in a mildly competitive, yet non-threatening environment, and makes the task of learning color recognition an enjoyable one. The present color game will find favor among preschoolers and other younger persons, but will enjoy use in the home and other environments as well.

It is to be understood that the present invention is not limited to the embodiments described above, but encompasses any and all embodiments within the scope of the following claims.

I claim:

1. A color game, comprising:

a plurality of individual player cards, with each of said cards having a triangular playing area and being distinct from one another;

a plurality of color positions disposed upon each of said player cards, the positions being aligned in rows, at least one of said rows having at least one of said color positions therein and at least one other of said rows having a maximum number of said color positions therein;

a plurality of colors disposed upon said plurality of color positions of each of said player cards;

a plurality of player card color position markers for placing upon each of said color positions of each of said player cards and corresponding in number to at least said plurality of color positions of all of said player cards;

a single caller board;

a plurality of color positions disposed upon said caller board, the caller board color positions being arranged in a plurality of rows, each of said rows having a plurality of the caller board color positions therein corresponding to said maximum number;

a plurality of colors disposed upon said plurality of caller board color positions;

a plurality of caller board color position markers for placing upon each of said caller board color positions and corresponding in number to at least said plurality of caller board color positions, with said caller board color position markers having colors corresponding to said plurality of colors of said plurality of caller board color positions; and a caller board color position marker container, for sequentially and randomly selecting said caller board color position markers therefrom:

wherein all of said color positions of each of said rows of each of said player cards and the caller board color positions of said caller board are identically colored, and each of said rows of each of said player cards and of said caller board are colored differently from one another.

2. The color game according to claim 1, wherein said plurality of said color positions is randomly disposed upon each of the rows of each of said player cards.

3. A color game, comprising:

a plurality of individual player cards, with each of said cards having a triangular playing area and being distinct from one another;

a plurality of color positions disposed upon each of said player cards, the positions being aligned in rows, at least one of said rows having at least one of said color positions therein and at least one other of said rows having a maximum number of said color positions therein;

a plurality of colors disposed upon said plurality of color positions of each of said player cards a plurality of player card color position markers for placing upon each of said color positions of each of said player cards and corresponding in number to at least said plurality of color positions of all of said player cards;

a single caller board;

a plurality of color positions disposed upon said caller board, the caller board color positions being arranged in a plurality of rows, each of said rows having a plurality of the caller board color positions therein corresponding to said maximum number;

a plurality of colors disposed upon said plurality of caller board color positions;

a plurality of caller board color position markers for placing upon each of said caller board color positions and corresponding in number to at least said plurality of caller board color positions, with said caller board color position markers having colors corresponding to said plurality of colors of said plurality of caller board color positions;

a caller board color position marker container, for sequentially and randomly selecting said caller board color position markers therefrom;

each of said player cards further includes a single first row having a single one of said color positions therein;

a single last row having said maximum number of said color positions therein;

at least one intermediate row having an intermediate number of said color positions therein;

said color positions of each said row increasing incrementally from said single one of said color positions of said first row to said maximum number of said color position of said last row; and said caller board color positions of each of said rows of said caller board correspond in number to said maximum number of said color positions of said single last row of each of said player cards.

4. The color game according to claim 3, wherein said plurality of color rows of each of said player cards and the caller board color positions each have a range of between five and ten rows.

5. The color game according to claim 3, wherein:

said plurality of color rows of each of said player cards and of said caller board each comprise eight rows; and said plurality of colors disposed upon said rows of said player cards and of said caller board comprise red, orange, yellow, green, blue, violet, black, and brown.

6. A color game, comprising:

a plurality of individual player cards, with each of said cards being distinct from one another;

a plurality of color positions disposed in a hexagonal array upon each of said player cards, the positions being aligned in rows, at least one of said rows having at least one of said color positions therein and at least one other of said rows having a maximum number of said color positions therein;

a plurality of colors disposed upon said plurality of color positions of each of said player card;

a plurality of player card color position markers for placing upon each of said color positions of each of said player cards and corresponding in number to at least said plurality of color positions of all of said player cards;

a single caller board;

a plurality of color positions disposed upon said caller board, the caller board color positions being arranged in a plurality of rows, each of said rows having a plurality of the caller board color positions therein corresponding to said maximum number;

a plurality of colors disposed upon said plurality of caller board color positions;

a plurality of caller board color position markers for placing upon each of said caller board color positions and corresponding in number to at least said plurality of caller board color positions, with said caller board color position markers having colors corresponding to said plurality of colors of said plurality of caller board color positions; and a caller board color position marker container, for sequentially and randomly selecting said caller board color position markers therefrom.

* * * * *